US009791791B2

(12) United States Patent
Mizushima et al.

(10) Patent No.: US 9,791,791 B2
(45) Date of Patent: Oct. 17, 2017

(54) ELECTROPHOTOGRAPHIC PHOTORECEPTOR, ELECTROPHOTOGRAPHIC CARTRIDGE, IMAGE FORMING APPARATUS, AND CHARGE TRANSPORT SUBSTANCE

(71) Applicant: Mitsubishi Chemical Corporation, Chiyoda-ku (JP)

(72) Inventors: Tadashi Mizushima, Kanagawa (JP); Mitsuo Wada, Kanagawa (JP); Yuka Nagao, Kanagawa (JP)

(73) Assignee: MITSUBISHI CHEMICAL CORPORATION, Chiyoda-ku (JP)

( * ) Notice: Subject to any disclaimer, the term of this patent is extended or adjusted under 35 U.S.C. 154(b) by 0 days.

(21) Appl. No.: 15/211,386

(22) Filed: Jul. 15, 2016

(65) Prior Publication Data

US 2016/0320717 A1 Nov. 3, 2016

Related U.S. Application Data

(63) Continuation of application No. PCT/JP2015/051425, filed on Jan. 20, 2015.

(30) Foreign Application Priority Data

Jan. 21, 2014 (JP) ..... 2014-008594
Jan. 31, 2014 (JP) ..... 2014-017157

(51) Int. Cl.

| | |
|---|---|
| ***G03G 5/06*** | (2006.01) |
| ***G03G 5/043*** | (2006.01) |
| ***G03G 5/05*** | (2006.01) |
| ***G03G 15/00*** | (2006.01) |

(52) U.S. Cl.

CPC ..... *G03G 5/0433* (2013.01); *G03G 5/0564* (2013.01); *G03G 5/0596* (2013.01); *G03G 5/0614* (2013.01); *G03G 5/0662* (2013.01); *G03G 15/75* (2013.01)

(58) Field of Classification Search

CPC ..... G03G 5/06
See application file for complete search history.

(56) References Cited

U.S. PATENT DOCUMENTS

| | | | | |
|---|---|---|---|---|
| 5,733,697 | A | 3/1998 | Endoh et al. | |
| 9,400,438 | B2 * | 7/2016 | Fujii | G03G 5/0614 |
| 9,507,284 | B2 * | 11/2016 | Wada | C07C 217/92 |
| 2005/0079374 | A1 | 4/2005 | Asai | |
| 2011/0299887 | A1 | 12/2011 | Miyaji et al. | |
| 2013/0343783 | A1 | 12/2013 | Miyaji et al. | |

FOREIGN PATENT DOCUMENTS

| | | |
|---|---|---|
| JP | 4-287049 | 10/1992 |
| JP | 5-142793 | 6/1993 |
| JP | 9-292724 | 11/1997 |
| JP | 2000-214608 | 8/2000 |
| JP | 2003-221601 | 8/2003 |
| JP | 2006-267197 | 10/2006 |
| JP | 2008-63230 | 3/2008 |
| JP | 2008-70591 | 3/2008 |
| JP | 2012-14141 | 1/2012 |

OTHER PUBLICATIONS

International Search Report issued Mar. 17, 2015 in PCT/JP2015/051425, filed Jan. 20, 2015 (with English Translation).
Written Opinion Report issued Mar. 17, 201 5 in PCT/JP2015/051425, filed Jan. 20, 2015.

* cited by examiner

*Primary Examiner* — Hoa V Le
(74) *Attorney, Agent, or Firm* — Oblon, McClelland, Maier & Neustadt, L.L.P.

(57) ABSTRACT

The present invention relates to an electrophotographic photoreceptor comprising a conductive support and a photosensitive layer disposed thereover, wherein the photosensitive layer comprises a compound represented by general formula (1) and palladium, the photosensitive layer having a palladium content of 0.01-50 ppm.

(1)

20 Claims, 2 Drawing Sheets

[Fig. 1]
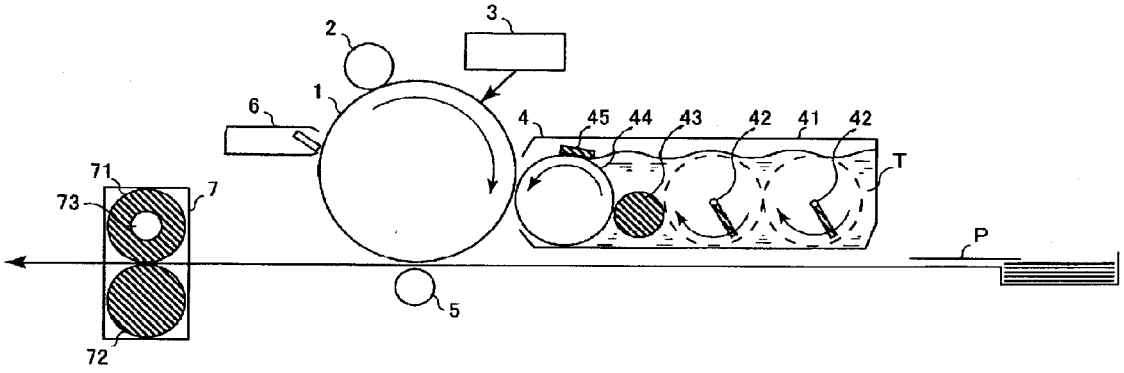
[Fig. 2]
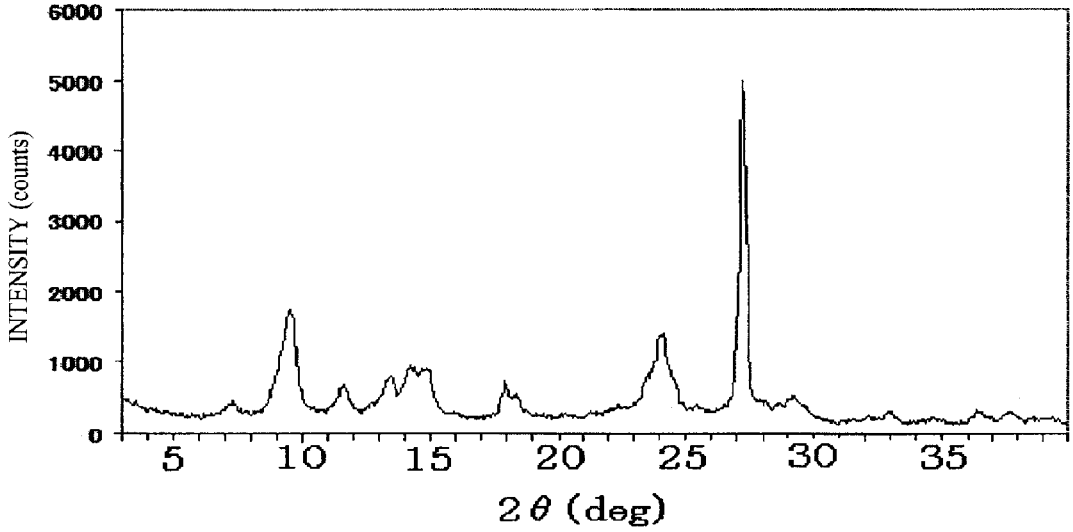

[Fig. 3]
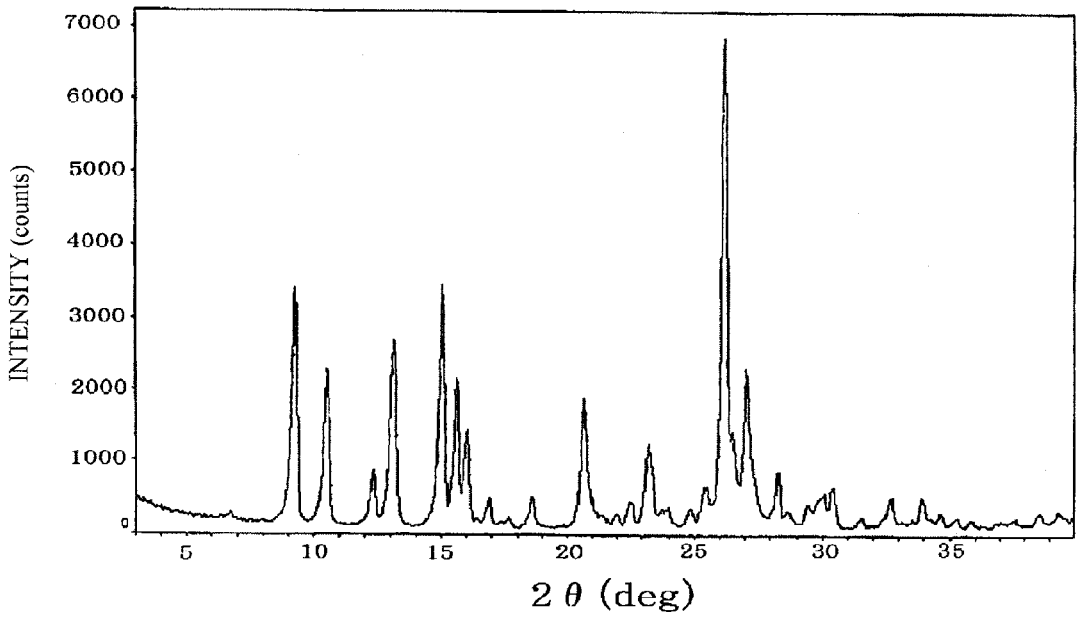

ELECTROPHOTOGRAPHIC PHOTORECEPTOR, ELECTROPHOTOGRAPHIC CARTRIDGE, IMAGE FORMING APPARATUS, AND CHARGE TRANSPORT SUBSTANCE

TECHNICAL FIELD

The present invention relates to an electrophotographic photoreceptor which, even when repeatedly used in a high-temperature and high-humidity environment even in a full-color image forming apparatus, does not cause blind spots, and to an electrophotographic cartridge, an image forming apparatus, and a charge transport substance.

BACKGROUND ART

Electrophotography is recently used and applied extensively not only in the field of copiers but also in the field of various printers, because of the advantages thereof such as instantaneousness, the ability of produce high-quality images, etc. With respect to photoreceptors, which are the core of electrophotography, photoreceptors employing, as the photoconductive material thereof, an organic photoconductive material having advantages such as non-pollution, ease of film formation, and ease of production are being developed in recent years.

There recently is a trend from monochrome toward full-color in both the copiers and printers which utilize electrophotography. Modes of the formation of a full-color image mainly include the tandem mode and the four-cycle mode. Meanwhile, modes of transfer to printing media include the direct transfer mode, transfer drum mode, intermediate transfer mode, multiple development/en bloc transfer mode, etc. Unlike apparatus for forming monochromatic images, apparatus for forming full-color images are required to satisfy an exceedingly high image quality level. Under these circumstances, there is a desire for a photoreceptor which can maintain high image quality even when suffering excess stress in special environments (e.g., high-temperature and high-humidity environment).

With respect to the quality of images produced with photoreceptors, the charge transport substances greatly contribute thereto. Various charge transport substances have been put to practical use, such as carbazole derivatives, hydrazone derivatives, stilbene derivatives, butadiene derivatives, and enamine derivatives. For example, it has been proposed that a triarylamine/stilbene hybrid compound having high sensitivity be used as a charge transport substance for electrophotographic photoreceptors (patent document 1).

PRIOR ART DOCUMENT

Patent Document

Patent Document 1: JP-A-9-292724

SUMMARY OF THE INVENTION

Problem that the Invention is to Solve

However, even in the case where the triarylamine/stilbene hybrid compound is used as a charge transport substance for electrophotographic photoreceptors, there has been a problem in that high image quality cannot be maintained in cases when the photoreceptors suffer excess stress. Repeated use of such photoreceptors at a high temperature and a high humidity results in the occurrence of blind spots, which is problematic especially in the case of full-color image forming apparatus.

The present invention has been achieved in view of that problem. An object of the invention is to provide an electrophotographic photoreceptor which does not cause blind spots even when repeatedly used in a high-temperature and high-humidity environment even in a full-color image forming apparatus, and to provide an electrophotographic cartridge, and an image forming apparatus.

Means for Solving the Problem

The present inventors diligently made investigations and, as a result, have discovered that by using a photoreceptor produced by a specific process using a specific charge transport substance or by using a photoreceptor employing the specific charge transport substance, satisfactory image quality free from blind spots can be provided even when the photoreceptor is repeatedly used at a high temperature and a high humidity. The present invention, which will be described below, has been thus accomplished.

Essential points of the invention reside in the following <1> to <12>.

<1>

An electrophotographic photoreceptor comprising a conductive support and a photosensitive layer disposed thereover, wherein the photosensitive layer comprises a compound represented by general formula (1) and palladium, the photosensitive layer having a palladium content of 0.01-50 ppm, (1)

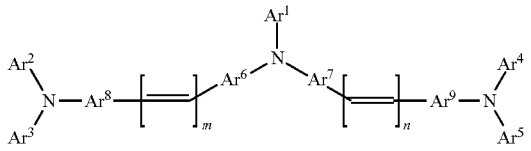

wherein $Ar^1$ to $Ar^5$ each independently represent an aryl group which may have a substituent, $Ar^6$ to $Ar^9$ each independently represent a 1,4-phenylene group which may have a substituent, and m and n each independently represent an integer of 1 to 3.

<2>

An electrophotographic photoreceptor comprising a conductive support and, disposed thereover, a photosensitive layer which contains a charge transport substance, wherein the charge transport substance comprises a compound represented by general formula (1) and palladium, the charge transport substance having a palladium content of 0.01-150 ppm, (1)

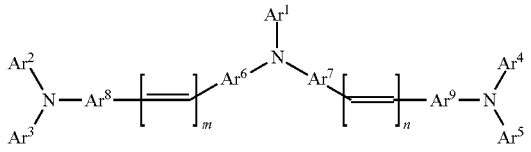

wherein $Ar^1$ to $Ar^5$ each independently represent an aryl group which may have a substituent, $Ar^6$ to $Ar^9$ each independently represent a 1,4-phenylene group which may have a substituent, and m and n each independently represent an integer of 1 to 3.

<3>

The electrophotographic photoreceptor according to <1> or <2>, wherein the photosensitive layer contains a binder resin, the binder resin having a viscosity-average molecular weight of 40,000-100,000.

<4>

The electrophotographic photoreceptor according to any one of <1> to <3>, wherein the photosensitive layer is one formed from a coating fluid including an organic solvent and the content of a residual halogenated solvent in the photosensitive layer is 1.0 mg/g or less and the content of a residual halogen-free solvent in the photosensitive layer is 0.05-20.0 mg/g.

<5>

The electrophotographic photoreceptor according to any one of <1> to <4>, wherein the compound represented by formula (1) is contained in the photosensitive layer in an amount of 20-50 parts by mass per 100 parts by mass of the binder resin constituting the photosensitive layer.

<6>

The electrophotographic photoreceptor according to any one of <1> to <5>, wherein in formula (1), $Ar^1$ to $Ar^5$ each independently are an aryl group which may have an alkyl or alkoxy group, $Ar^6$ to $Ar^9$ each independently are a 1,4-phenylene group which may have a substituent, and m and n are 1.

<7>

The electrophotographic photoreceptor according to any one of <1> to <6>, wherein the photosensitive layer contains a binder resin and the binder resin is a polyarylate resin or a polycarbonate resin.

<8>

The electrophotographic photoreceptor according to any one of <1> to <7>, wherein the compound represented by formula (1) is a compound which has been purified using an adsorbent.

<9>

The electrophotographic photoreceptor according to any one of <1> to <8>, which is for use in a full-color image forming apparatus.

<10>

An electrophotographic cartridge which comprises: the electrophotographic photoreceptor according to any one of <1> to <9>; and at least one selected from the group consisting of a charging device which charges the electrophotographic photoreceptor, an exposure device which exposes the charged electrophotographic photoreceptor to light to form an electrostatic latent image, and a developing device which develops the electrostatic latent image formed in the surface of the electrophotographic photoreceptor.

<11>

A full-color image forming apparatus which comprises: the electrophotographic photoreceptor according to any one of <1> to <9>; a charging device which charges the electrophotographic photoreceptor; an exposure device which exposes the charged electrophotographic photoreceptor to light to form an electrostatic latent image; and a developing device which develops the electrostatic latent image formed in the surface of the electrophotographic photoreceptor.

<12>

A charge transport substance comprising a compound represented by general formula (1) and palladium, wherein a palladium content is 0.01-150 ppm, (1)

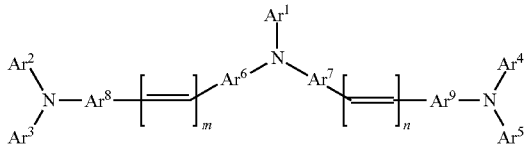

wherein $Ar^1$ to $Ar^5$ each independently represent an aryl group which may have an alkyl or alkoxy group, $Ar^6$ to $Ar^9$ each independently represent a 1,4-phenylene group which may have a substituent, and m and n each independently represent an integer of 1-2.

Effect of the Invention

The present invention makes it possible to provide an electrophotographic photoreceptor which, when repeatedly used in a high-temperature and high-humidity environment even in a full-color image forming apparatus, does not cause blind spots.

BRIEF DESCRIPTION OF THE DRAWINGS

FIG. 1 is a diagrammatic view showing the configuration of important parts of one embodiment of the image forming apparatus of the invention.

FIG. 2 is an X-ray diffraction pattern showing an X-ray powder diffraction spectrum of an oxytitanium phthalocyanine used in the Examples according to the invention and in the Comparative Examples.

FIG. 3 is an X-ray diffraction pattern showing an X-ray powder diffraction spectrum of another oxytitanium phthalocyanine used in the Examples according to the invention and in the Comparative Examples.

MODES FOR CARRYING OUT THE INVENTION

Modes for carrying out the invention are explained below in detail. However, the following explanations on constituent elements are for representative embodiments of the invention, and the embodiments can be suitably modified within the spirit of the invention.

<<Charge Transport Substance of the Invention>>

<Structure of the Charge Transport Substance>

The charge transport substance of the invention may be any charge transport substance which includes a compound represented by the following general formula (1) and palladium and has a palladium content of 0.01-150 ppm.

(1)

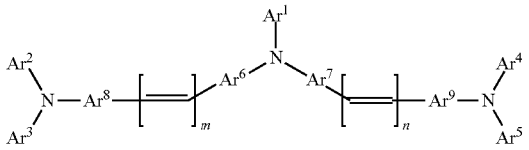

(In formula (1), $Ar^1$ to $Ar^5$ each independently represent an aryl group which may have a substituent, and $Ar^6$ to $Ar^9$ each independently represent a 1,4-phenylene group which may have a substituent. Furthermore, m and n each independently represent an integer of 1 to 3.)

In formula (1), $Ar^1$ to $Ar^5$ each independently represent an aryl group which may have a substituent. The number of carbon atoms of the aryl group is, for example, 30 or less, preferably 20 or less, more preferably 15 or less. Examples thereof include phenyl, naphthyl, biphenyl, anthryl, and phenanthryl. Preferred of these are phenyl, naphthyl, and anthryl, when the properties of the electrophotographic photoreceptor are taken into account. From the standpoint of charge-transporting ability, phenyl and naphthyl are more preferred, and phenyl is even more preferred.

Examples of the substituents which may be possessed by $Ar^1$ to $Ar^5$ include alkyl groups, aryl groups, alkoxy groups, and halogen atoms.

Specifically, examples of the alkyl groups include linear alkyl groups such as methyl, ethyl, n-propyl, and n-butyl, branched alkyl groups such as isopropyl and ethylhexyl, and cyclic alkyl groups such as cyclohexyl.

Examples of the aryl groups include phenyl and naphthyl groups which may have substituents.

Examples of the alkoxy groups include linear alkoxy groups such as methoxy, ethoxy, n-propoxy, and n-butoxy, branched alkoxy groups such as isopropoxy and ethylhexyloxy, cyclic alkoxy groups such as cyclohexyloxy, and alkoxy groups having a fluorine atom, such as trifluoromethoxy, pentafluoroethoxy, and 1,1,1-trifluoroethoxy.

Examples of the halogen atoms include fluorine, chlorine, and bromine atoms.

Preferred of these substituents which may be possessed by $Ar^1$ to $Ar^5$ are as follows. Preferred from the standpoint of the versatility of starting materials are alkyl groups having 1-20 carbon atoms and alkoxy groups having 1-20 carbon atoms. More preferred from the standpoint of handleability during production are alkyl groups having 1-12 carbon atoms and alkoxy groups having 1-12 carbon atoms. Even more preferred from the standpoint of the photo-attenuation characteristics of the electrophotographic photoreceptor are alkyl groups having 1-6 carbon atoms and alkoxy groups having 1-6 carbon atoms.

In the case where $Ar^1$ to $Ar^5$ are phenyl, it is preferable, from the standpoint of charge-transporting ability, that these phenyl groups each should have a substituent. Although the number of substituents can be 1-5, the number thereof is preferably 1-3 from the standpoint of the versatility of starting materials, and is more preferably 1-2 from the standpoint of the properties of the electrophotographic photoreceptor.

In the case where $Ar^1$ to $Ar^5$ are naphthyl, it is preferable, from the standpoint of the versatility of starting materials, that the number of substituents should be 2 or less or that each naphthyl group should have no substituent. More preferably, each naphthyl group has one or no substituent. It is preferable that $Ar^1$ should have at least one substituent at an ortho or the para position to the nitrogen atom, and the substituent preferably is an alkoxy group having 1-6 carbon atoms or an alkyl group having 1-6 carbon atoms, from the standpoint of solubility.

In formula (1), $Ar^6$ to $Ar^9$ each independently represent a 1,4-phenylene group which may have a substituent. Examples of the substituents which may be possessed by $Ar^6$ to $Ar^9$ include the same substituents which were enumerated above as the substituents that may be possessed by $Ar^1$ to $Ar^5$. Preferred of these from the standpoint of the versatility of starting materials are alkyl groups having 1-6 carbon atoms and alkoxy groups having 1-6 carbon atoms. More preferred from the standpoint of handleability during production are alkyl groups having 1-4 carbon atoms and alkoxy groups having 1-4 carbon atoms. Even more preferred from the standpoint of the photo-attenuation characteristics of the electrophotographic photoreceptor are methyl, ethyl, methoxy, and ethoxy.

In cases when $Ar^6$ to $Ar^9$ have substituents, the molecular structure is distorted and there is a possibility that the intramolecular $\pi$ conjugated extension might be inhibited thereby, resulting in a decrease in electron-transporting ability. It is hence preferable that $Ar^6$ to $Ar^9$ should have no substituent.

Symbols m and n each independently represent an integer of 1-3. There is a tendency that as m and n become larger, the solubility in coating solvents decreases. It is therefore preferable that m and n should be 2 or smaller. From the standpoint of the charge-transporting ability of the charge transport substance, m and n more preferably are 1.

In the case where m and n are 1, this indicates that the groups are ethenyl and have geometrical isomers. From the standpoint of the properties of the electrophotographic photoreceptor, trans isomer structures are preferred. In the case where m and n are 2, this indicates that the groups are butadienyl and have geometrical isomers in this case also. However, from the standpoint of the storage stability of coating fluids, a mixture of two or more geometrical isomers is preferred. The photosensitive layer may be one which contains only one compound represented by formula (1) or can be one which contains a mixture of compounds represented by formula (1).

Especially preferred as the charge transport substance is a compound represented by the following formula (1a). Formula (1a) is formula (1) in which $Ar^1$ is a phenyl group having an alkyl group, alkoxy group, aryloxy group, or aralkyloxy group, $Ar^2$ to $Ar^5$ each independently are a phenyl group which may have as a substituent an alkyl group having 1-6 carbon atoms, $Ar^6$ to $Ar^9$ are each an unsubstituted 1,4-phenylene group, and m and n are each 1.

(1a)

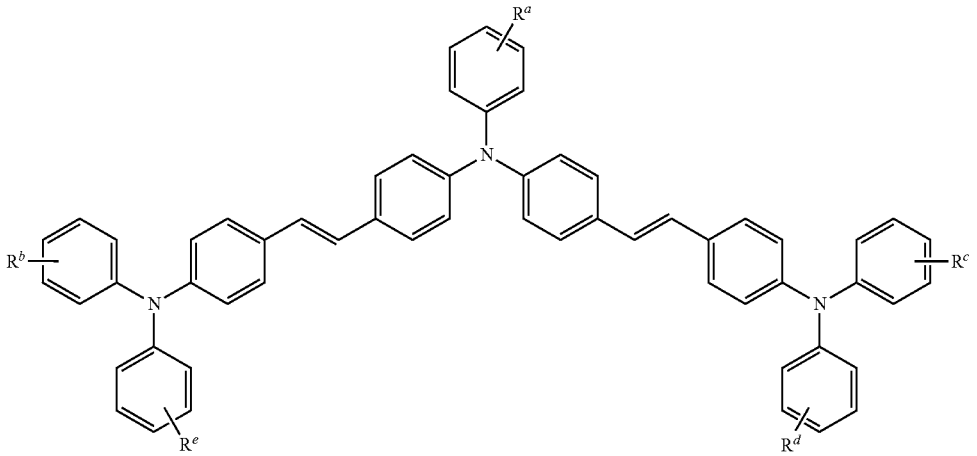

(In formula (1a), $R^a$ to $R^e$ each independently represent an alkyl group, an alkoxy group, an aryloxy group, an aralkyloxy group, or a hydrogen atom.)

The structures of compounds suitable for the invention are shown below as examples. The following structures are mere examples for more specifically illustrating the present invention, and the compound represented by formula (1) should not be construed as being limited to the following structures unless the structures depart from the spirit of the invention. In the formulae, Me denotes methyl, Et denotes ethyl, and Bu denotes butyl.

CT1

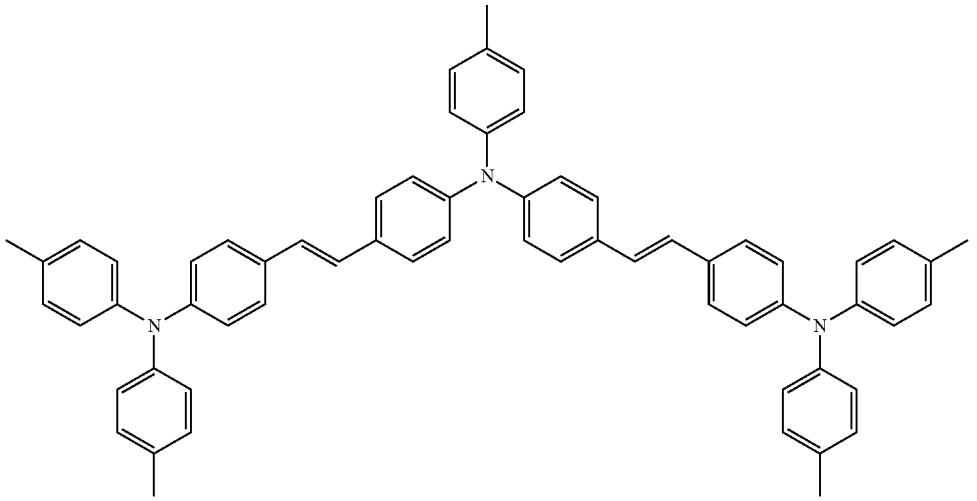

-continued
CT2
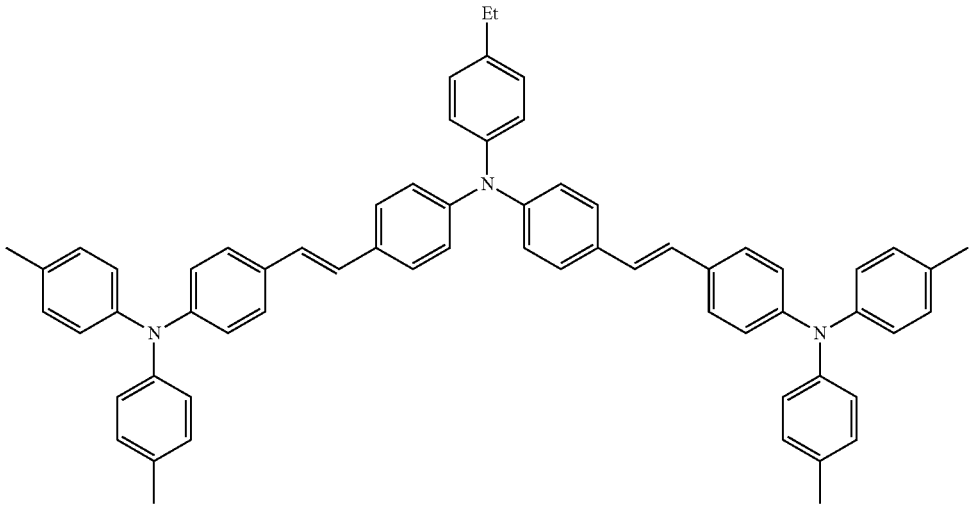
CT3
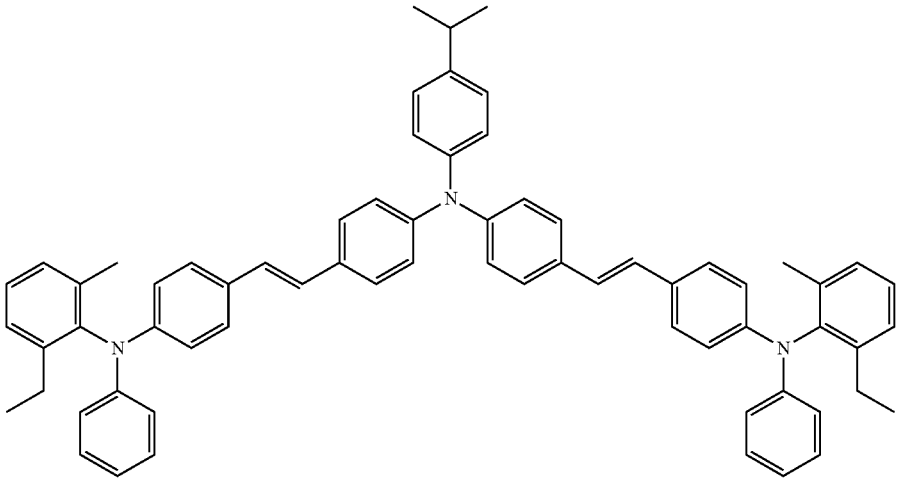
CT4
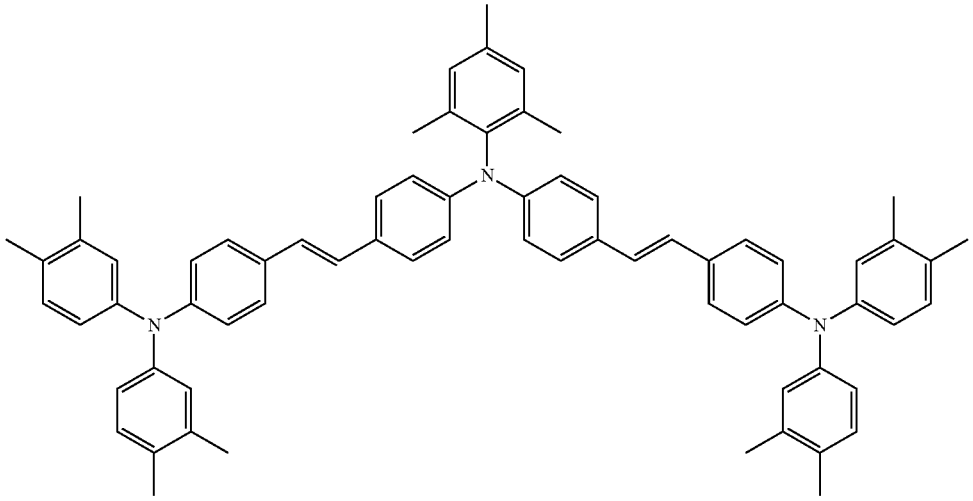

-continued
CT5
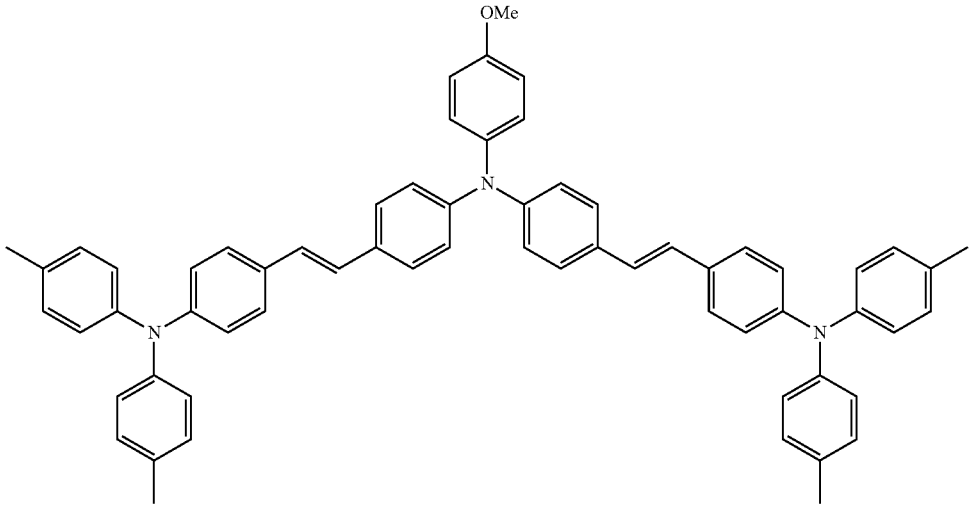
CT6
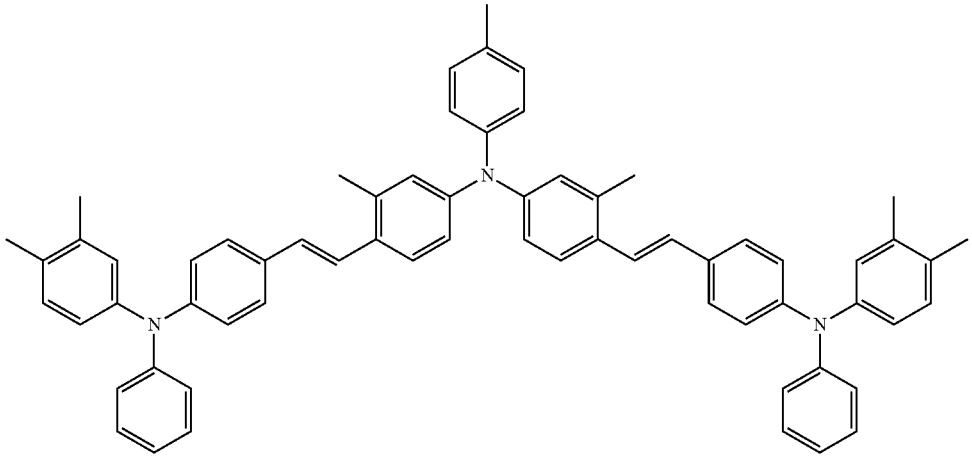
CT7
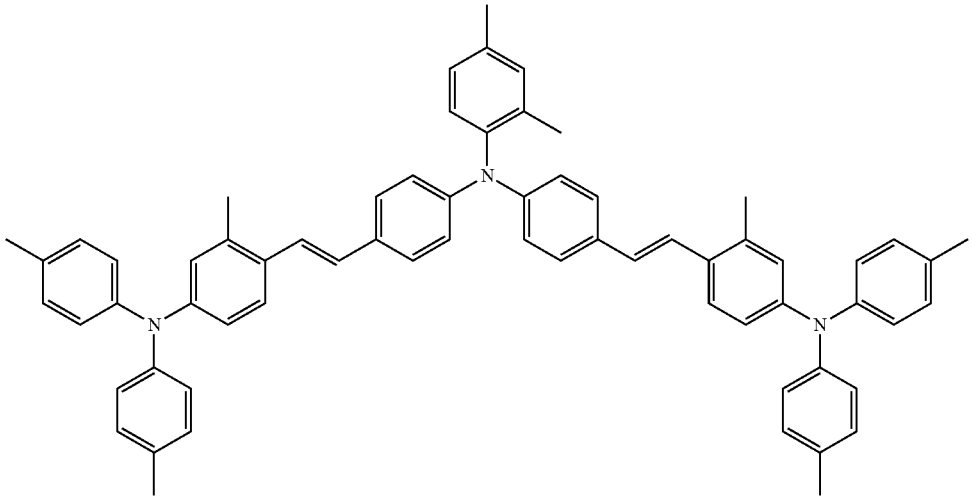

-continued
CT8
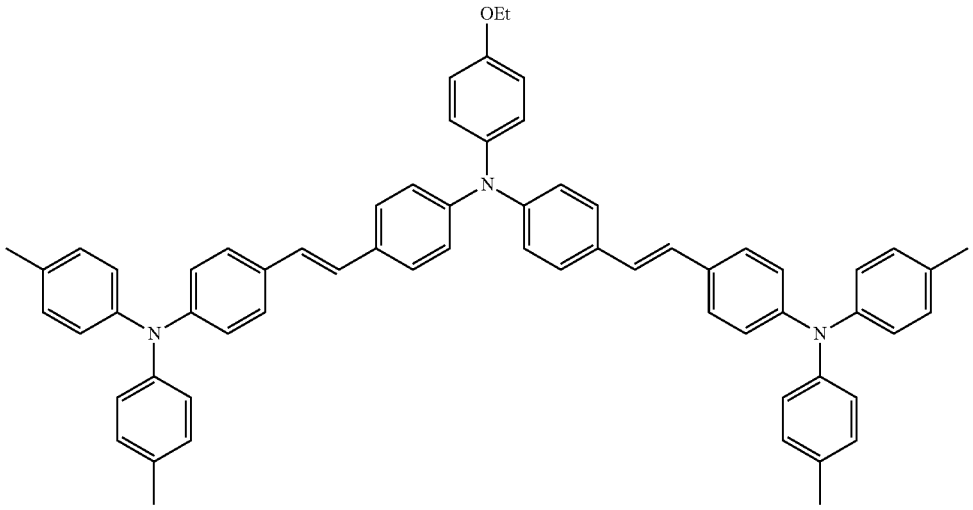
CT9
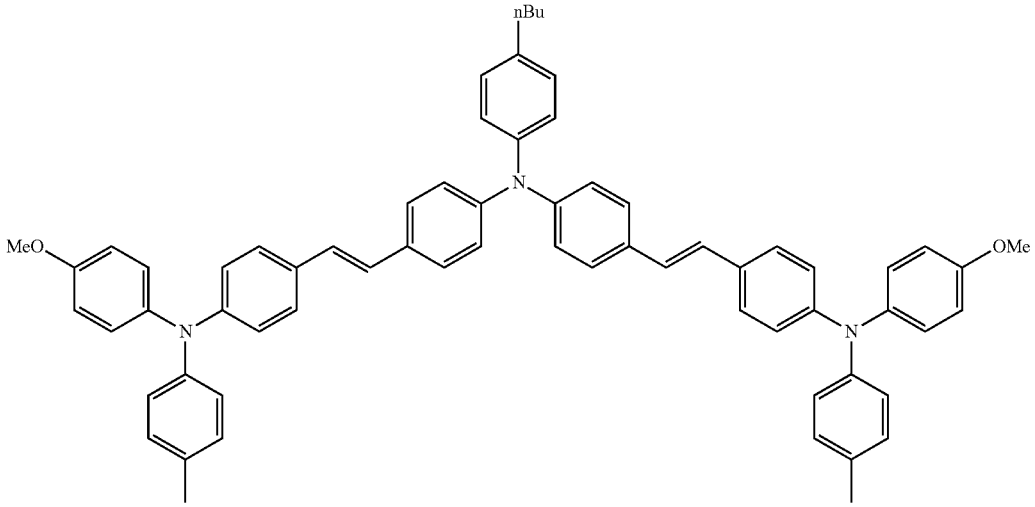
CT10
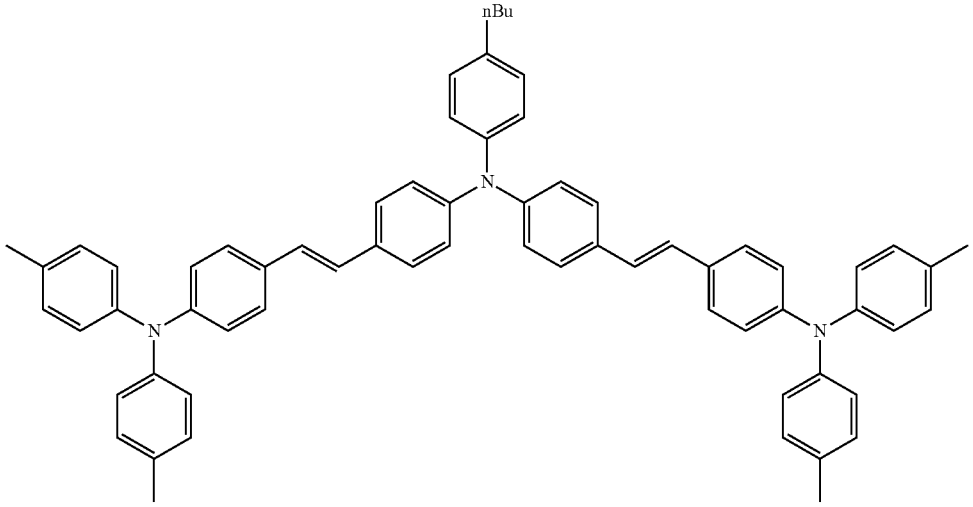

-continued
CT11
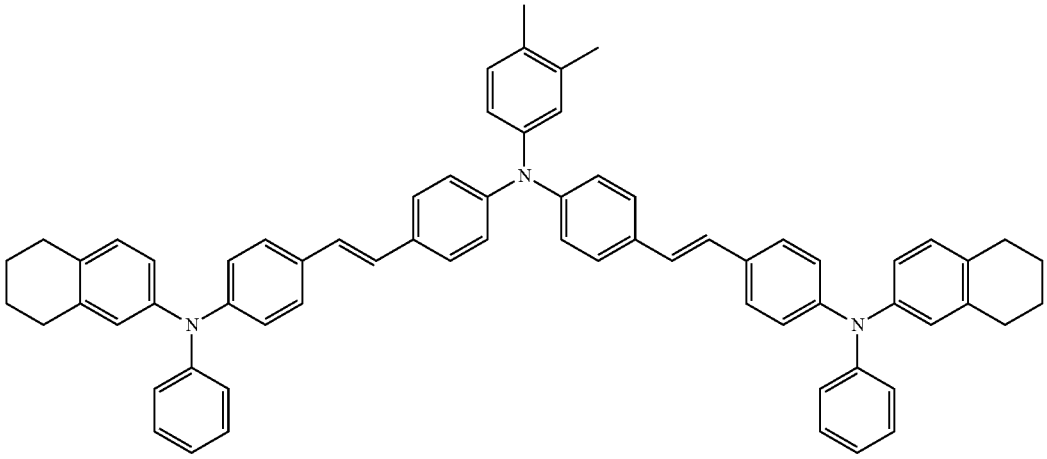
CT12
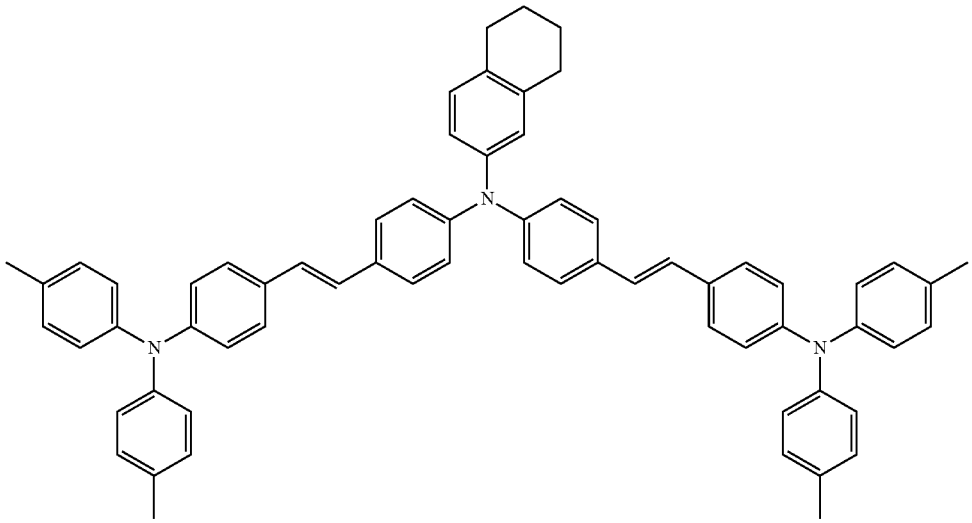
CT13
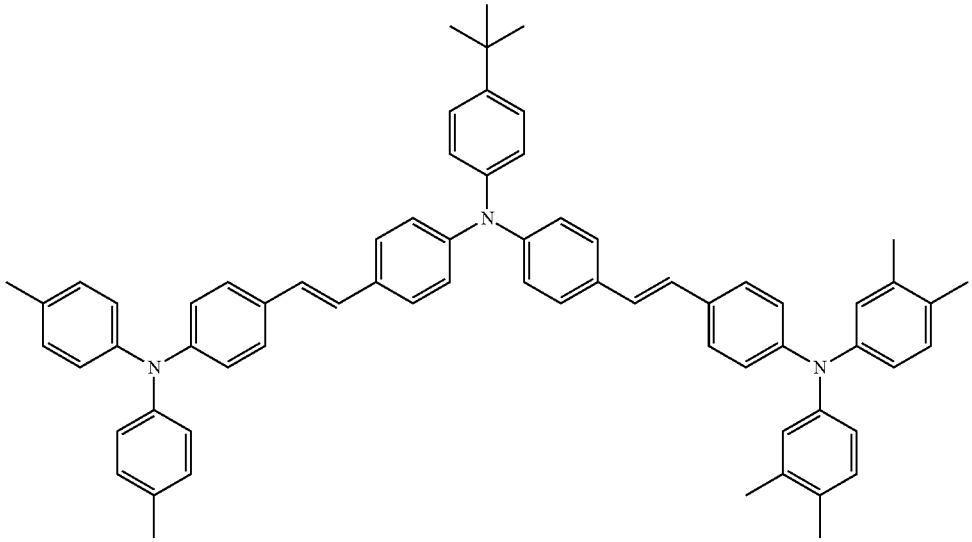

-continued
CT14
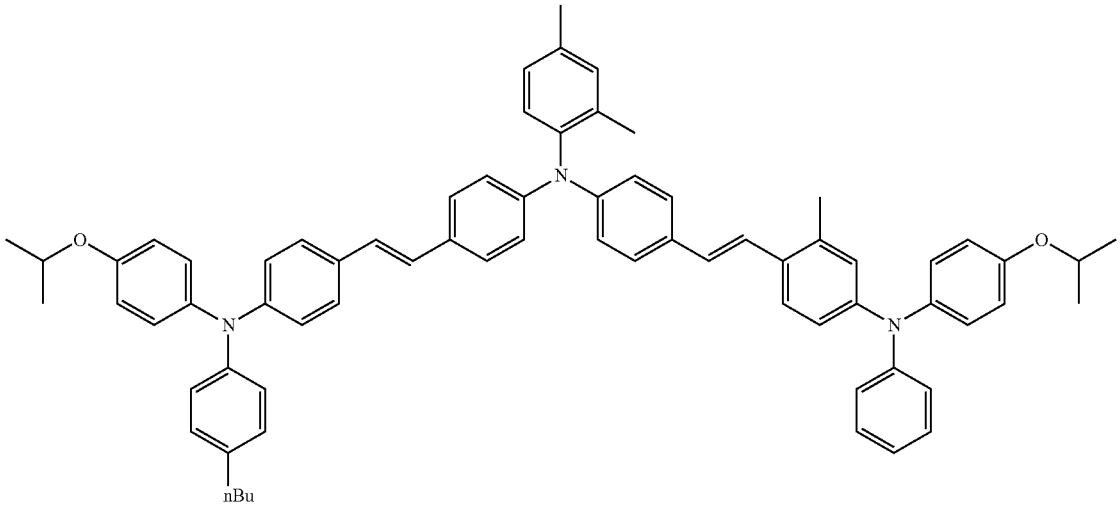
CT15
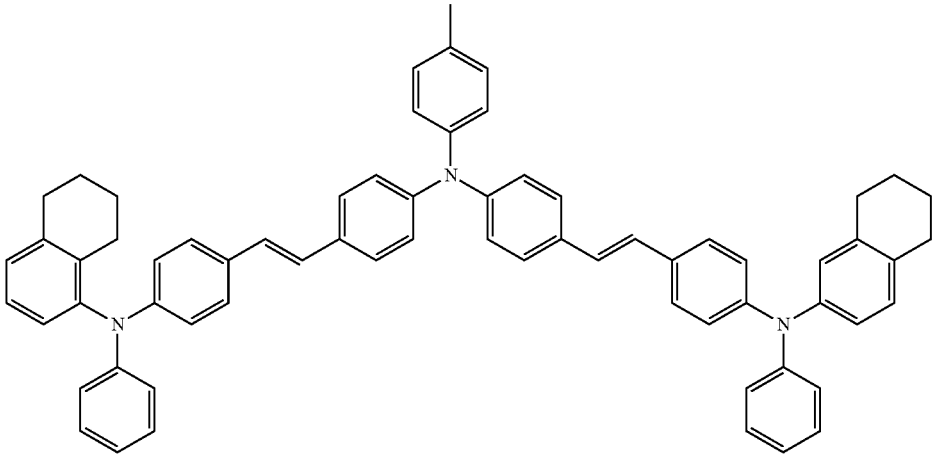
CT16
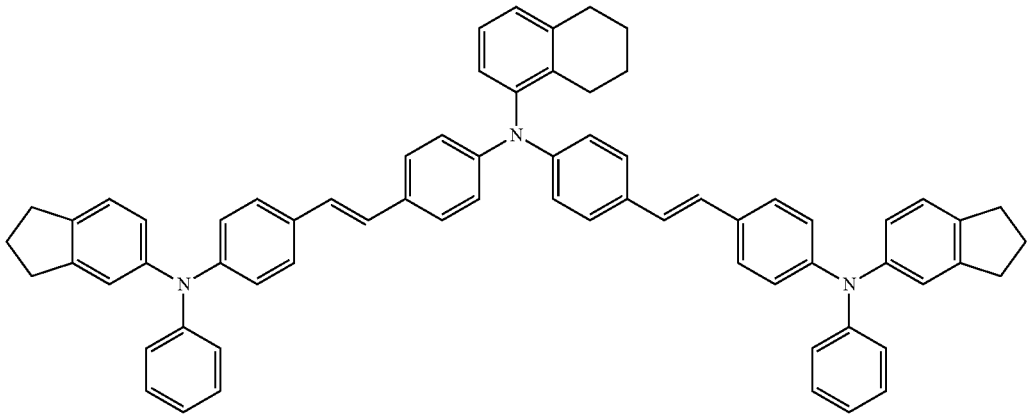

-continued
CT17
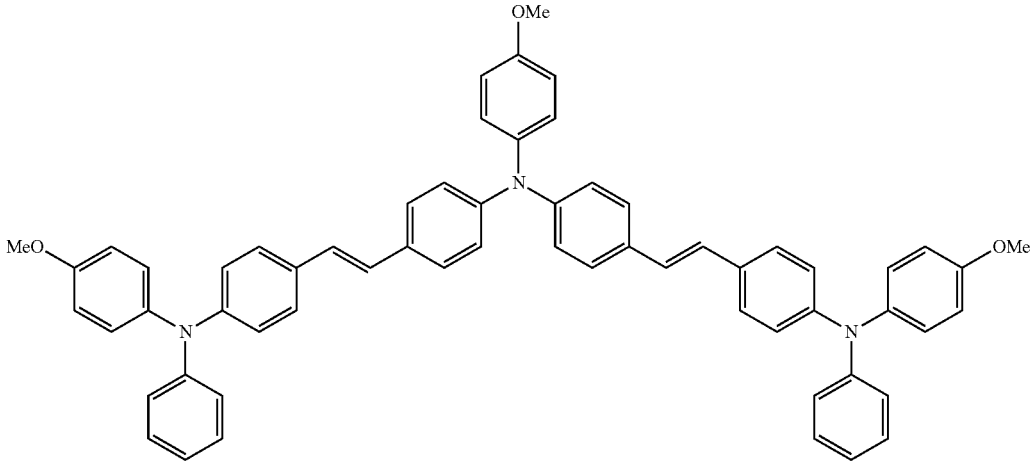
CT18
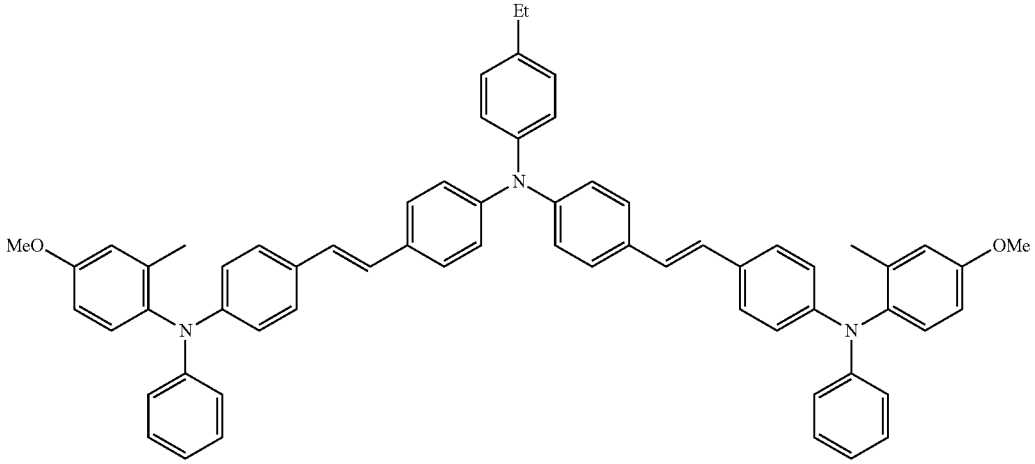
CT19
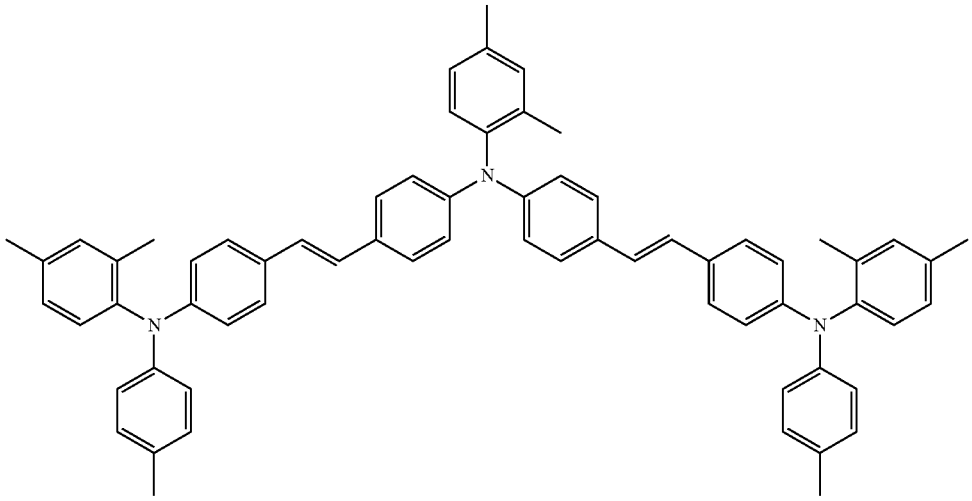

-continued
CT20
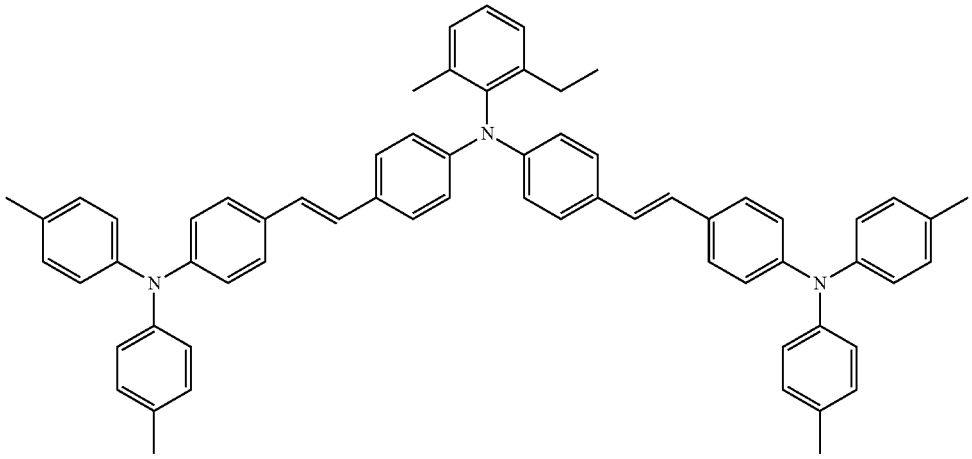
CT21
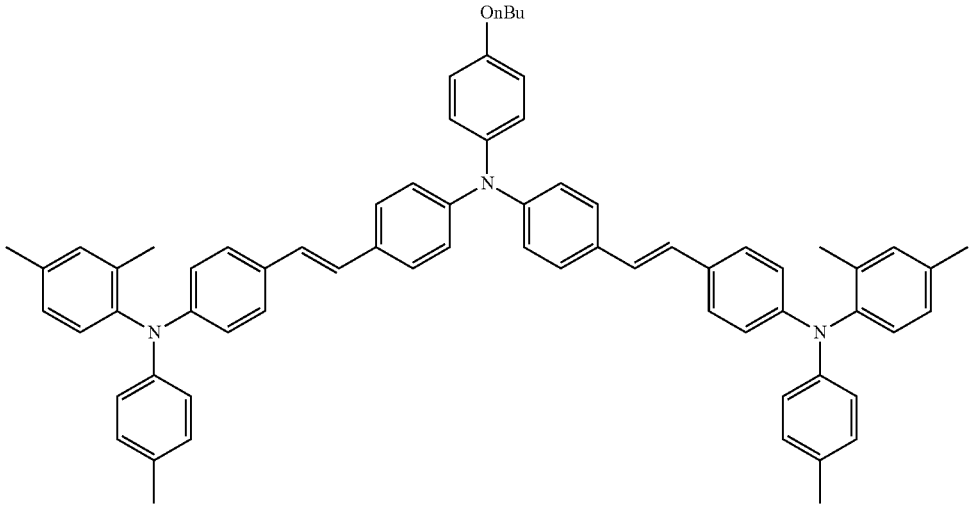
CT22
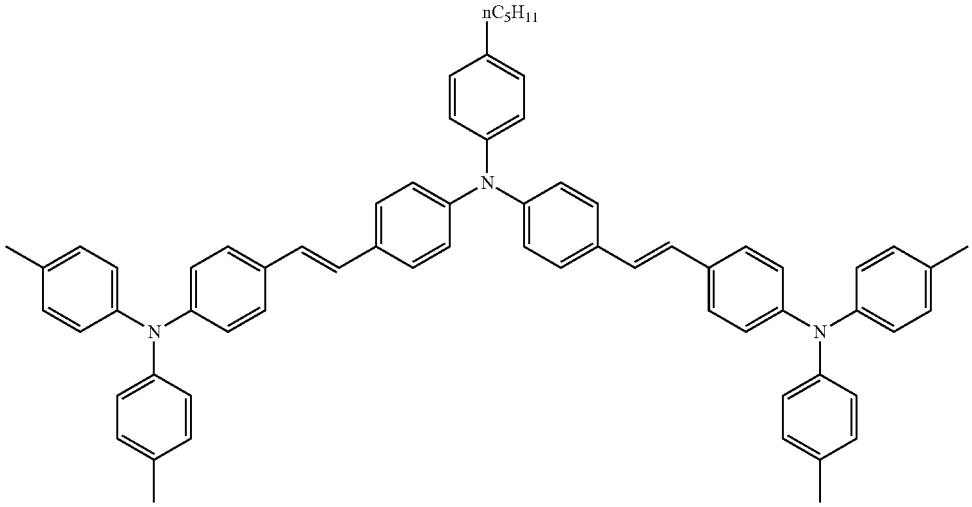

-continued
CT23
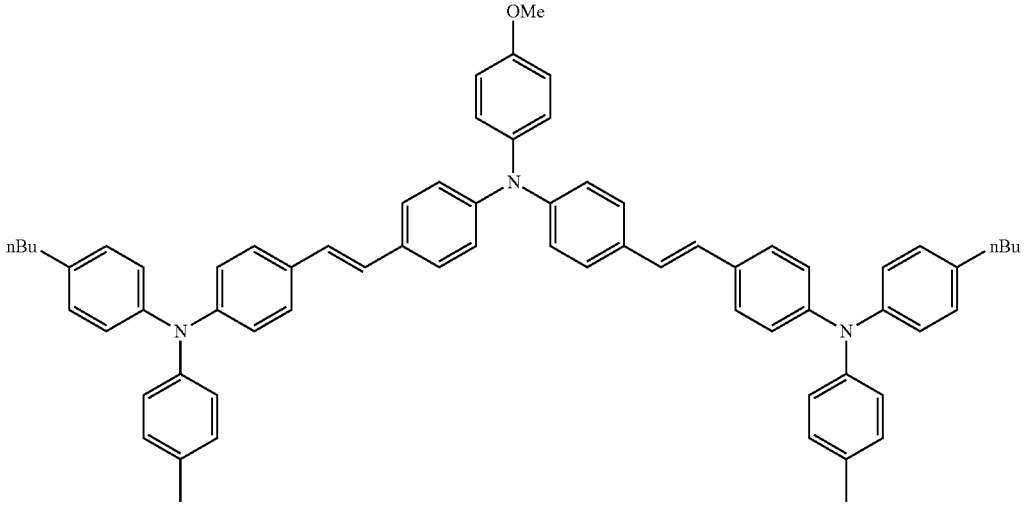
CT24
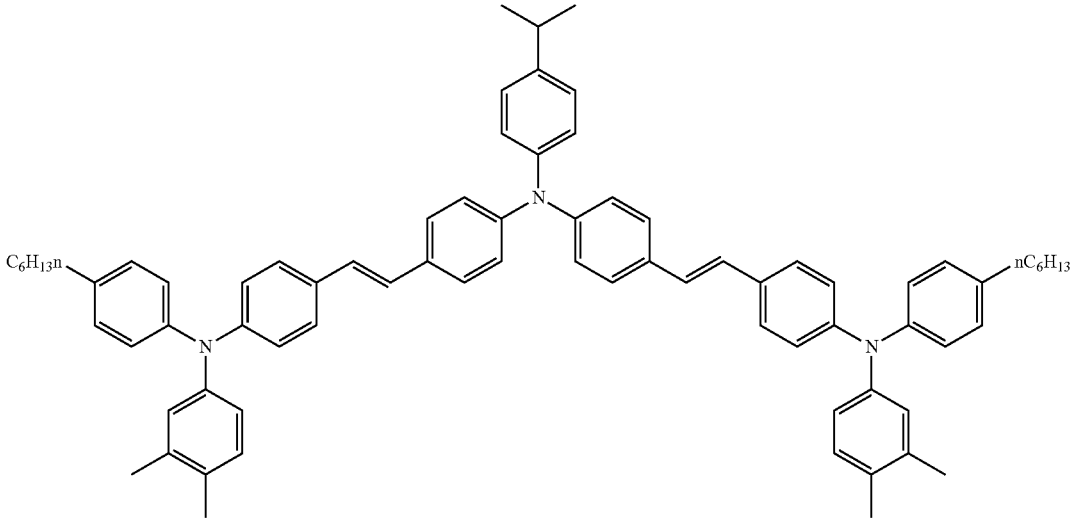
CT25
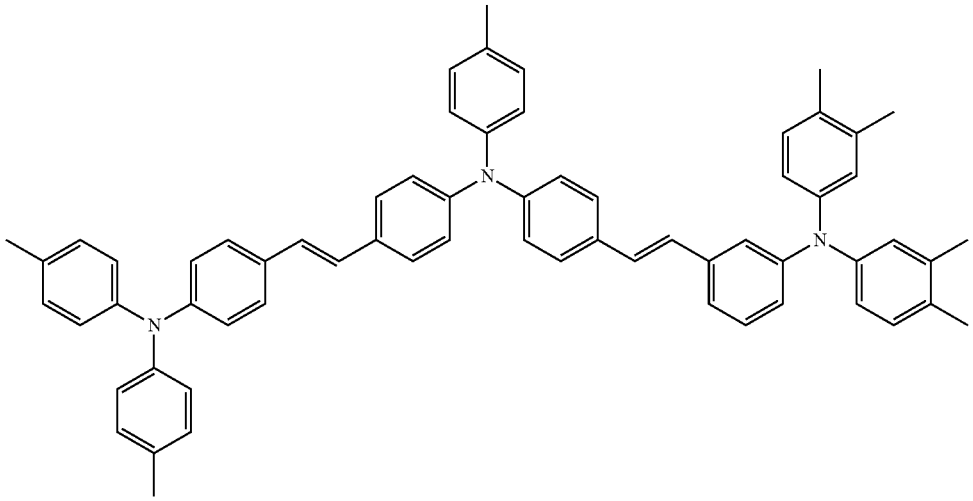

-continued
CT26
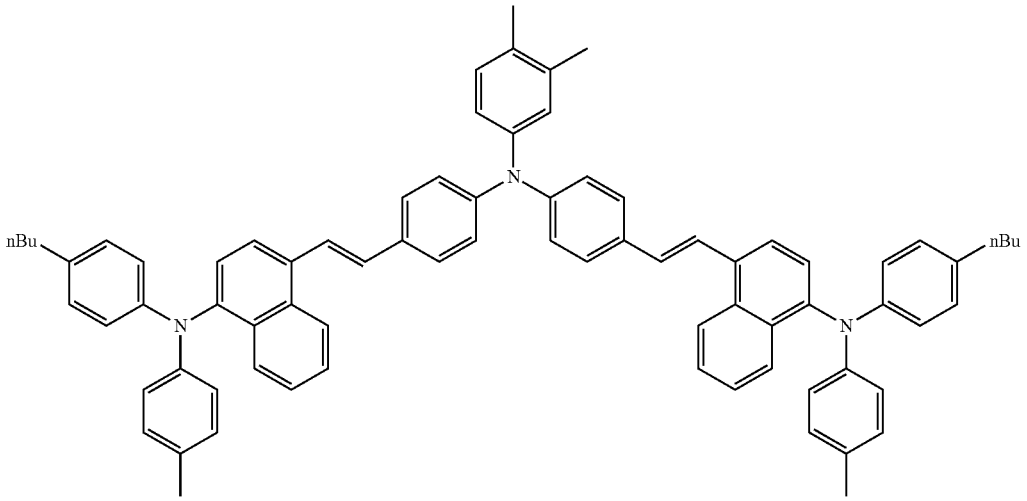
CT27
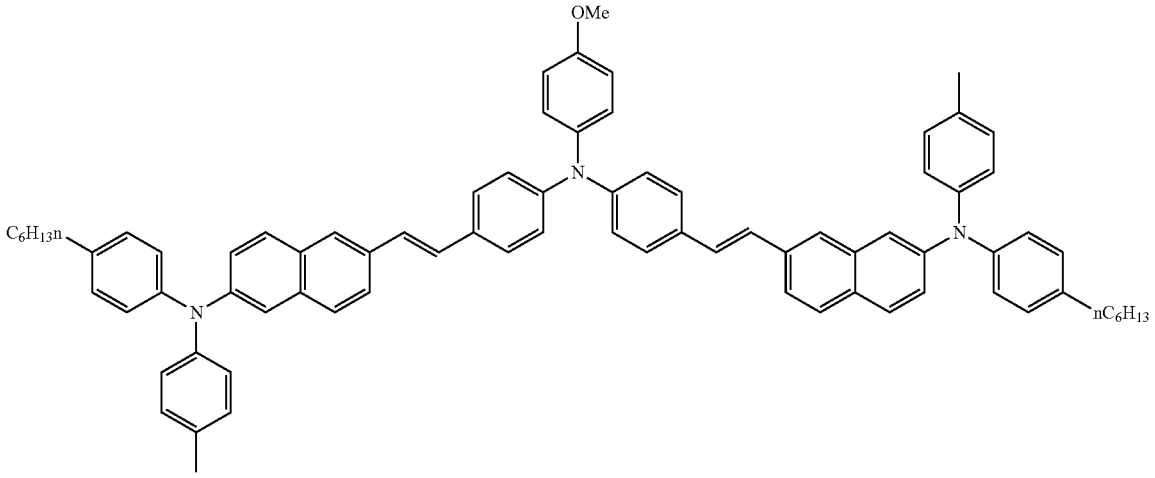
CT28
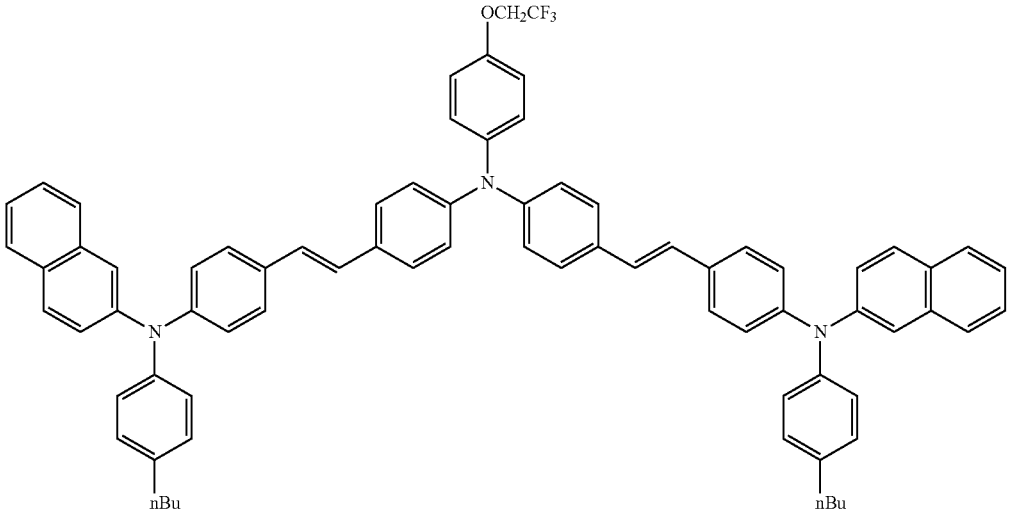

-continued
CT29
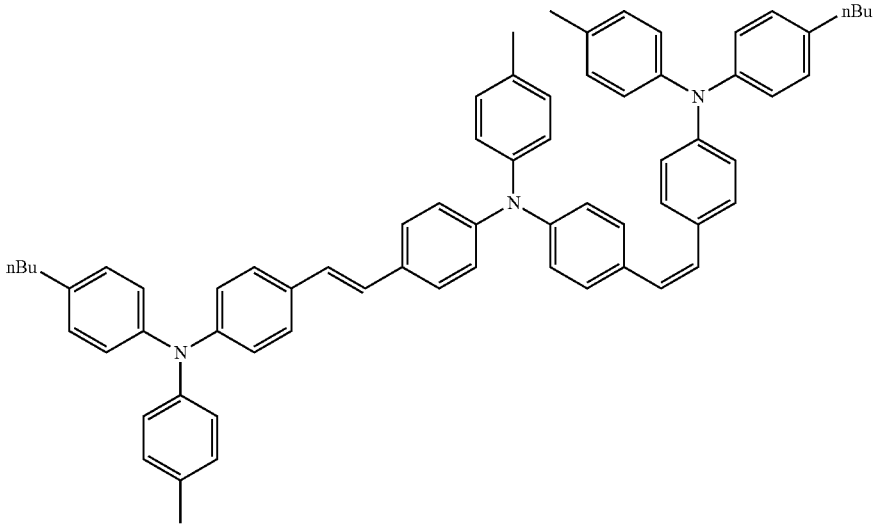
CT30
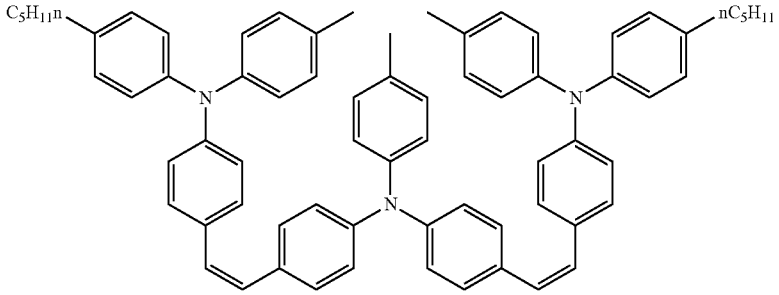
CT31
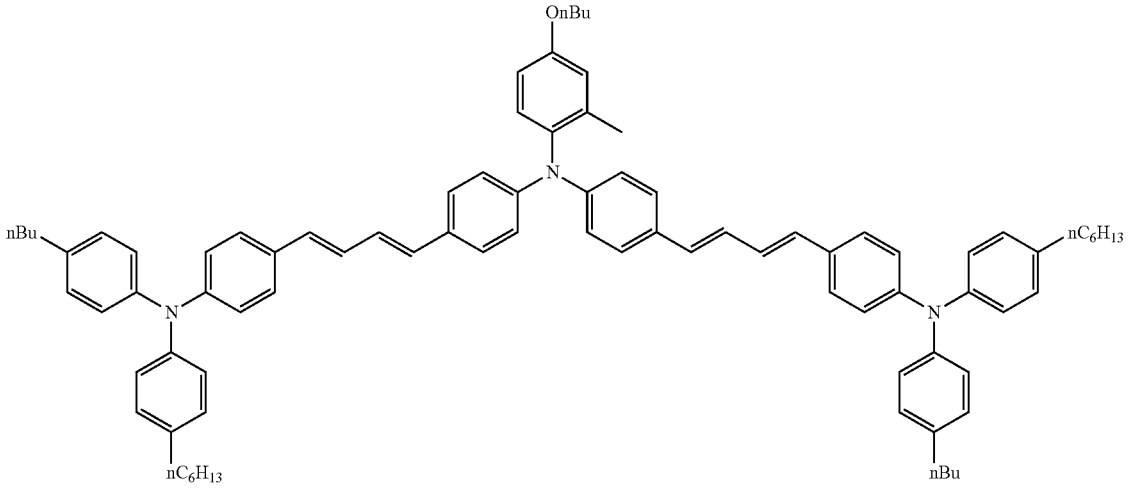

-continued

CT32

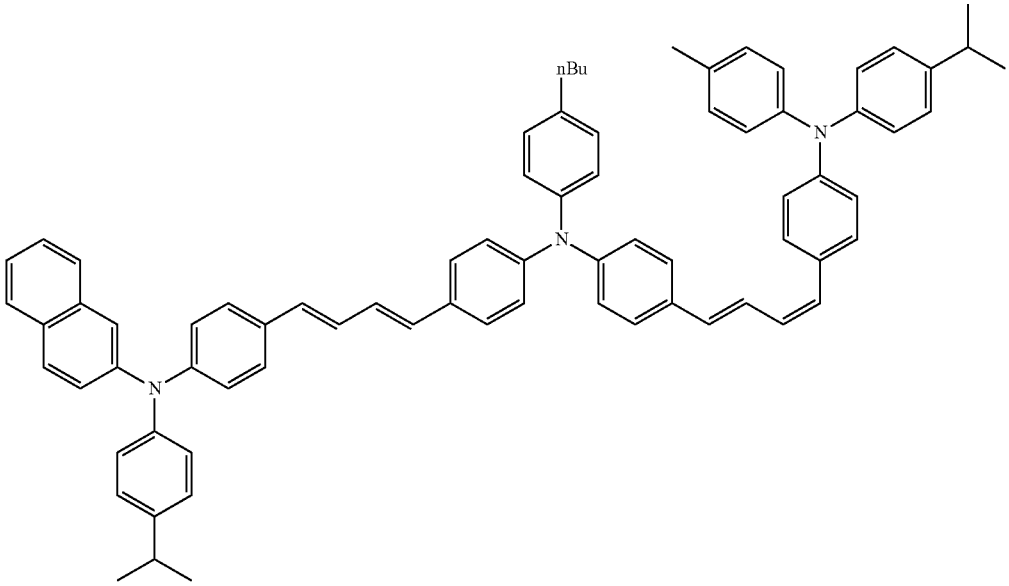

With respect to the proportion of the binder resin to the charge transport substance including a compound represented by formula (1), in the photosensitive layer, the charge transport substance is used usually in an amount of 15 parts by mass or larger per 100 parts by mass of the binder resin within the same layer. The amount thereof is preferably 20 parts by mass or larger from the standpoint of reducing residual potential, and is more preferably 25 parts by mass or larger from the standpoints of stability during repeated use and of charge mobility.

Meanwhile, from the standpoint of the thermal stability of the photosensitive layer, the charge transport substance is usually used in an amount of 70 parts by mass or less. The amount of the charge transport substance including a compound represented by formula (1) is preferably 65 parts by mass or less from the standpoint of compatibility between the charge transport substance and the binder resin, and is more preferably 60 parts by mass or less from the standpoint of heat resistance. The amount thereof is preferably 50 parts by mass or less from the standpoint of scratch resistance, and is especially preferably 45 parts by mass or less from the standpoint of wear resistance.

<Process for producing the Charge Transport Substance>

A preferred process for producing the charge transport substance represented by general formula (1) is a process that includes: a step in which a compound represented by general formula (1) is synthesized using a palladium compound; and a step in which the charge transport substance represented by general formula (1) is purified using an adsorbent so that the palladium content therein is reduced to 0.01-150 ppm.

(Step of Synthesis)

An example of the charge transport substance which was shown above can be produced in accordance with the following scheme 1. In the case of the compound shown as an example, the crude compound which has not undergone a purification treatment can be synthesized by subjecting a triphenylamine derivative having a halogen atom and an aniline compound to a coupling reaction using a palladium compound as a catalyst.

<Scheme 1>

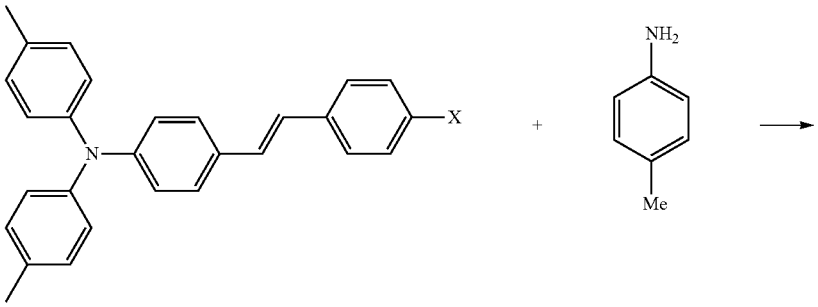

-continued

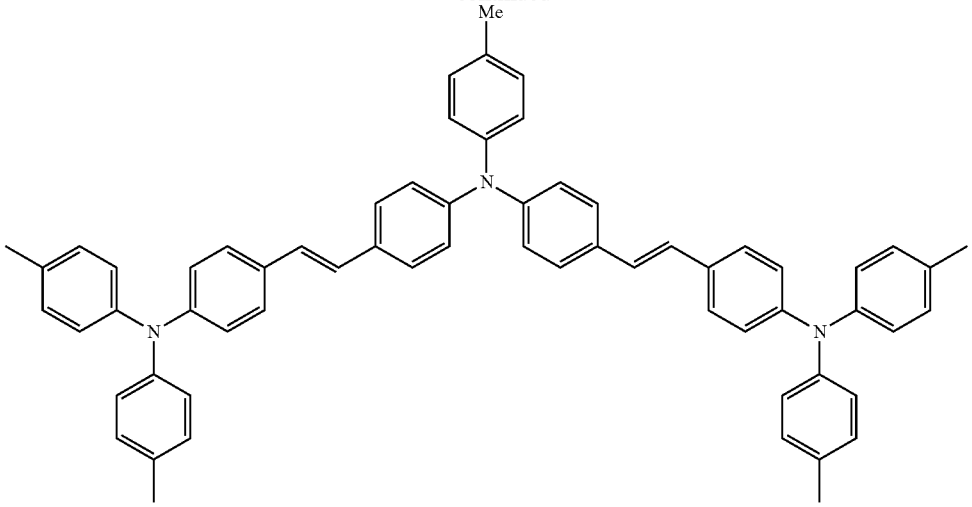

(In the scheme, X represents a halogen atom.)

Examples of the palladium compound include compounds of tetravalent palladium, such as sodium hexachloropalladate tetrahydrate and potassium hexachloropalladate tetrahydrate, compounds of divalent palladium, such as palladium acetate, palladium chloride, palladium bromide, palladium acetylacetate, dichlorobis(benzonitrile)palladium, dichlorobis(triphenylphosphine)palladium, dichlorotetraminepalladium, and dichloro(cycloocta-1,5-diene)palladium, tris(dibenzylideneacetone)dipalladium, tris(dibenzylideneacetone)dipalladium/chloroform complex, tetrakis(triphenylphosphine)palladium, and allylpalladium(II) chloride dimer. Preferred of these, from the standpoint of yield, are palladium acetate and allylpalladium(II) chloride dimer, which are compounds of divalent palladium.

It is also possible to conduct the coupling reaction in the presence of a compound which becomes a ligand, the compound being caused to be present in the system together with the palladium compound. Preferred as the compound which becomes a ligand is a phosphorus compound.

Examples thereof include phosphine compounds, phosphite compounds, phosphoramidite compounds, and triaminophosphine compounds. Preferred of these are phosphine compounds from the standpoint of yield. Examples of the phosphine compounds include alkylphosphine derivatives such as tricyclohexylphosphine and tri-tert-butylphosphine and arylphosphine derivatives such as triphenylphosphine and tri-o-tolylphosphine. Preferred of these are alkylphosphine derivatives from the standpoint of yield.

The amount of the palladium compound to be used in the coupling reaction per mole of the triphenylamine derivative compound having a halogen atom may be as follows. From the standpoint of yield, a lower limit of the amount thereof is usually 0.0002 mol or larger, preferably 0.0005 mol or larger, more preferably 0.001 mol or larger. From the standpoint of ease of purification, an upper limit of the amount thereof is 10 mol or less, preferably 1 mol or less, more preferably 0.5 mol or less, even more preferably 0.1 mol or less.

(Step of Purification)

The crude compound thus synthesized in accordance with scheme 1 can be purified into the state of having a specific palladium content which renders the compound usable in electrophotographic photoreceptors, by subjecting the crude compound to a purification treatment with an adsorbent.

Any known adsorbent can be used in methods for the purification with an adsorbent. Specific examples of the adsorbent include activated carbon, silica gel, alumina, activated clay, Florisil, and diatomaceous earth. Preferred of these, from the standpoint of the properties of the electrophotographic photoreceptor, are activated carbon, silica gel, activated clay, and Florisil. From the standpoint of production cost, activated carbon, activated clay, and Florisil are more preferred, and activated clay and Florisil are even more preferred.

The purification treatment with an adsorbent is performed usually by dissolving the crude charge transport substance in an organic solvent and bringing the solution into contact with the adsorbent. Organic solvents usable in the purification treatment are not particularly limited so long as the charge transport substance can be dissolved therein. However, when an adsorption-desorption equilibrium between the adsorbent and the charge transport substance is taken into account, an aromatic hydrocarbon-based solvent or an aliphatic hydrocarbon-based solvent is preferred.

Preferred examples of the aromatic hydrocarbon-based solvent include benzene, toluene, o-xylene, m-xylene, p-xylene, o-cymene, m-cymene, p-cymene, anisole, ethylxylene, ethyltoluene, ethylanisole, methylnaphthalene, and diphenylmethane.

Preferred examples of the aliphatic hydrocarbon-based solvent include n-hexane, n-heptane, n-octane, n-decane, n-dodecane, 2,3-dimethylhexane, 2-methylheptane, 2-methylhexane, 3-methylhexane, and cyclohexane.

Preferred of those solvents are the aromatic hydrocarbon-based solvents, from the standpoint of operating efficiency during production. In particular, aromatic hydrocarbon-based solvents having a boiling point of 150° C. or lower are preferred. Of these, toluene and xylene are more preferred, and toluene is even more preferred. Any one of these solvents may be used as a single solvent, or any two or more thereof may be mixed together and used as a mixed solvent.

The amount of the organic solvent to be used can be selected from among various values in accordance with the solubility of the crude compound. However, the amount thereof in terms of (crude compound)/(organic solvent) mass ratio is usually 0.01 or larger, preferably 0.05 or larger, from the standpoint of the efficiency of producing the charge transport substance, and is usually 0.5 or less, preferably 0.4 or less, more preferably 0.3 or less, from the standpoint of the efficiency of purifying the charge transport substance.

With respect to the amount of the adsorbent to be used, too large adsorbent amounts relative to the amount of the crude compound may result in a reduced purification yield due to poor filterability, etc. and in an adverse influence of the oxidizing ability of the adsorbent on the hole-transporting ability of the charge transport substance. Consequently, the amount of the adsorbent to be used, in terms of (adsorbent)/(crude compound) mass ratio, is usually 1.5 or less, preferably 1.2 or less, more preferably 1.0 or less.

Meanwhile, from the standpoint of lessening the adverse influence of the oxidizing ability of the adsorbent on the arylamine compound, too small adsorbent amounts result in a decrease in purification efficiency. Consequently, that mass ratio is usually 0.001 or higher, preferably 0.005 or higher, more preferably 0.01 or higher.

The charge transport substance to be used in the invention may be purified by a combination of two or more purification methods, i.e., a combination of the method for purification with an adsorbent and other purification method(s). Examples of the other purification methods usable in combination with the method of purification with an adsorbent include: a reprecipitation method in which a good solvent having a high affinity for the charge transport substance is used to dissolve the charge transport substance therein to prepare a solution and the solution is then added to a poor solvent to solidify the charge transport substance; and a crystallization method in which the charge transport substance is dissolved, with heating, in a solvent having a high affinity therefor and the resultant solution is cooled and matured as such or is mixed with a poor solvent and then cooled and matured, thereby precipitating crystals.

From the standpoint of image quality during image formation, it is preferred to purify the charge transport substance using at least the adsorption method and one or more other purification methods. More preferred is combined use of the adsorption method and the reprecipitation method or combined use of the adsorption method and the crystallization method.

The palladium content in the charge transport substance is 150 ppm or less, more preferably 120 ppm or less, even more preferably 100 ppm or less, from the standpoint of electrical property. From the standpoint of reducing the load of purification and in view of the burden to be imposed on the charge transport substance by the purification, the palladium content therein is 0.01 ppm or higher, preferably 0.1 ppm or higher, more preferably 0.5 ppm or higher, even more preferably 1 ppm or higher. By using any of the adsorbents, purification techniques, and conditions in combination, the palladium content can be satisfied.

The purity of the charge transport substance is preferably 97.0% or higher, more preferably 97.5% or higher, even more preferably 98.0% or higher, from the standpoint of electrical property. From the standpoint of solubility, the purity thereof is preferably 99.9% or less, more preferably 99.8% or less, even more preferably 99.7% or less.

Examples of techniques for attaining 97.0% or higher include a production process in which a palladium compound is used as a catalyst in combination with a ligand having a phosphorus atom. Meanwhile, examples of techniques for attaining 99.9% or less include purification methods such as crystallization treatment. From the standpoint of attaining a purity of 98.0% to 99.7%, it is preferred to purify the charge transport substance by a technique in which an adsorbent is used.

In cases when a charge transport substance is produced using a palladium compound, it is possible to highly efficiently produce the desired charge transport substance, but the palladium used remains in the charge transport substance. Furthermore, the crude charge transport substance which has not been purified contains a large amount of impurities that affect the electrophotographic photoreceptor properties, such as compounds yielded as by-products during the reaction, besides the palladium compound.

In the case of purifying the crude charge transport substance produced using a palladium compound, it is preferred not to remove the residual palladium compound only but to simultaneously further remove impurities which impair the photoreceptor properties. Although the purification may be thoroughly performed so that the residual palladium compound and the impurities yielded during the reaction can be entirely removed, such excess purification may result in cases where the structure itself of the charge transport substance changes due to the contact with the adsorbent, resulting in adverse influences which are greater than the effect of the purification. Meanwhile, in case where the purification is insufficient, the adverse influences of residual impurities are serious.

How the electrophotographic photoreceptor is adversely affected by the stress, such as transfer voltage, which is imposed thereon by the image forming apparatus varies considerably depending on combinations of the amounts and kinds of impurities with the structure of the charge transport substance. The amounts and kinds of compounds or impurities which may remain in the charge transport substance after the purification vary depending on the structure of the desired charge transport substance.

Especially in the case of the charge transport substance described above, the exertion of adverse influences thereon by the stress of transfer voltage imposed by the image forming apparatus is considerably affected by the residual palladium compound. Although the mechanism thereof is unclear, the following is presumed. Weak intermolecular force is apt to be exerted to between the charge transport substance and the residual palladium compound, and the photosensitive layer in which the weak intermolecular force is being exerted is prone to form charge trap sites therein upon application of a high voltage thereto from the image forming apparatus in a transfer step. These traps are presumed to exert an adverse influence on image quality.

Consequently, by performing the adsorbent treatment according to the invention to thereby purify the charge transport substance so as to result in the specific palladium content and simultaneously removing other impurities, the stress such as the transfer voltage imposed by the image forming apparatus is prevented from exerting adverse influences, making it possible to provide an electrophotographic photoreceptor which shows satisfactory properties.

Incidentally, the charge transport substance can be identified by NMR, IR, mass spectrometry, etc. Palladium content can be determined using an ICP emission spectrometer, and purity can be calculated by means of a liquid chromatograph. Examinations with the liquid chromatograph can be made using an apparatus having a UV-vis detector.

<<Electrophotographic Photoreceptor>>

The electrophotographic photoreceptor of the invention is explained below.

The photosensitive layer of the electrophotographic photoreceptor is disposed on a conductive support or disposed on an undercoat layer in cases when the undercoat layer is included. Examples of the types of photosensitive layers include the so-called single-layer type photoreceptor, in which a charge generation substance and a charge transport substance are present in the same layer and dispersed in a binder resin, and the so-called multilayer type photoreceptor, which has a double-layer structure in which functions have been allotted separately to two layers, i.e., a charge generation layer in which a charge generation substance is dispersed in a binder resin and a charge transport layer in which a charge transport substance is dispersed in a binder resin. The photosensitive layer according to the invention may have either of these configurations. An overcoat layer may be disposed on the photosensitive layer for the purpose of improving the charging properties or improving the wear resistance.

<Conductive Support>

Mainly used as the conductive support in the photoreceptor is, for example, a metallic material such as aluminum, an aluminum alloy, stainless steel, copper, or nickel, a resinous material to which electrical conductivity has been imparted by adding a conductive powder, e.g., a metal, carbon, or tin oxide powder, or a resin, glass, paper, or the like, the surface of which has been coated with a conductive material, e.g., aluminum, nickel, or ITO (indium oxide/tin oxide), by vapor deposition or coating fluid application.

With respect to the form thereof, the conductive support to be used may be in the form of a drum, sheet, belt, or the like. Use may also be made of a conductive support which is made of a metallic material and which has been coated with a conductive material having an appropriate resistance value for the purposes of controlling conductivity, surface properties, etc. or of covering defects.

In the case where a metallic material such as an aluminum alloy is used as a conductive support, this material may be used after an anodized coating film is formed thereon. In the case where an anodized coating film has been formed, the material can be subjected to a pore-filling treatment by a known method.

The surface of the support may be smooth, or may have been roughened by using a special machining method or by performing a grinding treatment. Alternatively, use may be made of a support having a roughened surface obtained by incorporating particles with an appropriate particle diameter into the material for constituting the support. Furthermore, a drawn pipe can be used as such without subjecting the pipe to machining, for the purpose of cost reduction. In the case of using an unmachined aluminum support obtained by through drawing, impact drawing, ironing, or the like, this support is especially preferred because adherent substances present on the surface, such as fouling substances and foreign matter, and minute flaws and the like, occurred by the processing have been eliminated and the support obtained is even and clean.

<Undercoat Layer>

An undercoat layer may be disposed between the conductive support and the photosensitive layer, which will be described later, in order to improve adhesiveness, antiblocking properties, etc. As the undercoat layer, use may be made, for example, of a resin or a resin in which particles of a metal oxide or the like have been dispersed.

Examples of the metal oxide particles for use in the undercoat layer include particles of a metal oxide containing one metallic element, such as titanium oxide, aluminum oxide, silicon oxide, zirconium oxide, zinc oxide, or iron oxide, and particles of a metal oxide containing a plurality of metallic elements, such as calcium titanate, strontium titanate, or barium titanate.

Particles of one kind selected from these may be used alone, or particles of two or more kinds may be mixed together and used. Preferred of those particulate metal oxides are titanium oxide and aluminum oxide. Especially preferred is titanium oxide. The titanium oxide particles may be ones, the surface of which has been treated with an inorganic substance such as tin oxide, aluminum oxide, antimony oxide, zirconium oxide, or silicon oxide or with an organic substance such as stearic acid, a polyol, or a silicone. With respect to the crystal form of the titanium oxide particles, any of rutile, anatase, brookite, and amorphous ones is usable. Furthermore, the titanium oxide particles may include particles in a plurality of crystal states.

Metal oxide particles having various particle diameters can be utilized. However, from the standpoints of electrical property and the stability of the coating fluid for undercoat layer formation, it is desirable to use metal oxide particles having an average primary-particle diameter which is usually 1 nm or larger, preferably 10 nm or larger, and is usually 100 nm or less, preferably 50 nm or less.

It is desirable that the undercoat layer should be formed so as to be configured of a binder resin and metal oxide particles dispersed therein. Examples of the binder resin to be used in the undercoat layer include known binder resins such as epoxy resins, polyethylene resins, polypropylene resins, acrylic resins, methacrylic resins, polyamide resins, vinyl chloride resins, vinyl acetate resins, phenolic resins, polycarbonate resins, polyurethane resins, polyimide resins, vinylidene chloride resins, poly(vinyl acetal) resins, vinyl chloride/vinyl acetate copolymers, poly(vinyl alcohol) resins, polyurethane resins, polyacrylic resins, polyacrylamide resins, polyvinylpyrrolidone resins, polyvinylpyridine resins, water-soluble polyester resins, cellulose ester resins such as nitrocellulose, cellulose ether resins, casein, gelatin, poly(glutamic acid), starch, starch acetate, aminostarch, organozirconium compounds such as zirconium chelate compounds and zirconium alkoxide compounds, organic titanyl compounds such as titanyl chelate compounds and titanyl alkoxide compounds, and silane coupling agents.

One of these resins may be used alone, or any desired combination of two or more thereof may be used in any desired proportion. The binder resin may be used together with a hardener to come into a hardened state. Alcohol-soluble copolyamides, modified polyamides, and the like are preferred of those because these resins show satisfactory dispersibility and applicability.

The proportion of the inorganic particles to be used, to the binder resin to be used in the undercoat layer, can be selected at will. However, from the standpoint of the stability and applicability of the dispersion, it is usually preferred to use the inorganic particles in an amount in the range of 10-500% by mass. The thickness of the undercoat layer can be selected at will. However, from the standpoint of improving the photoreceptor properties and applicability, the thickness thereof is usually preferably in the range of 0.1-20 μm.

A known antioxidant and the like may be incorporated into the undercoat layer. Pigment particles, resin particles, and the like may be incorporated into the layer to be used, for the purpose of, for example, preventing image defects.

<Photosensitive Layer>

The photosensitive layer contains a charge transport substance represented by general formula (1), and the charge transport substance has a palladium content of 0.01-150 ppm. The photosensitive layer may be either a single-layer type photosensitive layer or a multilayer type photosensitive layer. Examples of the multilayer type photosensitive layer include: a normal-stack type photosensitive layer obtained by superposing a charge generation layer and a charge transport layer in this order from the conductive-support side; and a reverse-stack type photosensitive layer obtained by disposing these layers in the reverse order, i.e., by superposing a charge transport layer and a charge generation layer in this order from the conductive-support side. Although either of these can be employed, the normal-stack type photosensitive layer is preferred because this photosensitive layer is capable of exhibiting especially well balanced photoconductivity.

The palladium content in the photosensitive layer is preferably 50 ppm or less, more preferably 45 ppm or less, even more preferably 40 ppm or less, from the standpoint of electrical property. From the standpoints of reducing the load of purification during production of the charge transport substance and of reducing the burden to be imposed on the charge transport substance during the purification, the palladium content therein is preferably 0.01 ppm or higher, more preferably 0.1 ppm or higher, even more preferably 0.5 ppm or higher.

By forming the photosensitive layer using a charge transport substance represented by formula (1) obtained by using any of the adsorbents, purification techniques, and conditions in combination, the palladium content can be satisfied. Palladium content may be determined by performing quantitative analysis in the following manner using an ICP emission spectrophotometer or an ICP mass spectrometer. First, some of the photosensitive layer is scraped from the photoreceptor, and a given amount thereof is examined. Next, this specimen is carbonized with a specimen pretreatment device, and the carbonized specimen is dissolved using any one of various acids including sulfuric acid and nitric acid or using a mixture of such acids. This solution is ashed to remove the organic matter, and the residue is dissolved using any one of various acids including sulfuric acid and nitric acid or using a mixture of such acids, thereby obtaining a sample. This sample is subjected to quantitative analysis for palladium using an ICP emission spectrophotometer or an ICP mass spectrometer.

Besides the materials which will be described later, known additives such as an antioxidant, plasticizer, ultraviolet absorber, electron-attracting compound, leveling agent, and visible-light-shielding agent may be incorporated into the photosensitive layer in order to improve the film-forming properties, flexibility, applicability, nonfouling properties, gas resistance, light resistance, etc.

The photosensitive layer may contain, according to need, various additives such as a leveling agent for improving applicability, an antioxidant, and a sensitizer. Examples of the antioxidant include hindered phenol compounds and hindered amine compounds. Examples of dyes or pigments include various colorant compounds and azo compounds. Examples of surfactants include silicone oils and fluorochemical oils.

Some of the solvent used in the coating fluid usually remains in the photosensitive layer. In the case of halogenated solvents which each have a halogen atom, e.g., chlorine, in the structure, there is a possibility that the solvents themselves might decompose during photoreceptor production or during long-term storage of the photoreceptor to thereby generate free halogens, etc. and impair the properties of the electrophotographic photoreceptor. Consequently, the content of such solvents is preferably 1.0 mg/g or less, and it is more preferable that no such solvents should remain in the photosensitive layer.

In the case of halogen-free solvents which each have no halogen atom in the structure, the content thereof in the photosensitive layer is usually 20.0 mg/g or less, preferably 15.0 mg/g or less, more preferably 12.5 mg/g or less, and is usually 0.05 mg/g or higher, preferably 0.1 mg/g or higher, more preferably 0.5 mg/g or higher, even more preferably 1.0 mg/g or higher. In case where the amount of the residual solvent in the photosensitive layer is too large, there is a possibility that the mechanical strength of the photoreceptor might be insufficient. In case where the amount thereof is too small, there is a possibility that the load of drying the photosensitive layer during photoreceptor production might be too high, resulting in a decrease in production efficiency.

<Charge Generation Layer>

The charge generation layer is formed by binding a charge generation substance with a binder resin. Examples of the charge generation substances include inorganic photoconductive materials, such as selenium, alloys thereof, and cadmium sulfide, and organic photoconductive materials such as organic pigments. However, organic photoconductive materials are preferred, and organic pigments are especially preferred.

Examples of the organic pigments include phthalocyanine pigments, azo pigments, dithioketopyrrolopyrrole pigments, squalene (squarylium) pigments, quinacridone pigments, indigo pigments, perylene pigments, polycyclic quinone pigments, anthanthrone pigments, and benzimidazole pigments. Especially preferred of these are phthalocyanine pigments or azo pigments. In the case of using any of these organic pigments as a charge generation substance, the organic pigment is used usually in the form of a dispersion layer in which fine particles thereof have been bound with any of various binders.

In the case of using a metal-free phthalocyanine compound or a metal-containing phthalocyanine compound as a charge generation substance, a photoreceptor having high sensitivity to laser light having a relatively long wavelength, e.g., laser light having a wavelength around 780 nm, is obtained. In the case of using an azo pigment such as a monoazo, diazo, or trisazo pigment, it is possible to obtain a photoreceptor having sufficient sensitivity to white light or to laser light having a wavelength around 660 nm or laser light having a relatively short wavelength, e.g., laser light having a wavelength around 450 nm or 400 nm.

In the case of using an organic pigment as a charge generation substance, a phthalocyanine pigment or an azo pigment is especially preferred. Phthalocyanine pigments are superior in that a photoreceptor having high sensitivity to laser light having a relatively long wavelength is obtained therewith, while azo pigments are superior in that the pigments have sufficient sensitivity to white light and laser light having a relatively short wavelength.

In the case of using a phthalocyanine pigment as a charge generation substance, use may be made specifically of metal-free phthalocyanines and phthalocyanine compounds to which a metal, e.g., copper, indium, gallium, tin, titanium, zinc, vanadium, silicon, germanium, or aluminum, or an oxide, halide, hydroxide, alkoxide, or another form of the metal has coordinated, these phthalocyanines and phthalocyanine compounds having respective crystal forms, and phthalocyanine dimers in which oxygen or other atoms are used as crosslinking atoms.

Especially suitable are X-form and τ-form metal-free phthalocyanines, which are crystal forms having high sensitivity, A-form (also called β-form), B-form (also called α-form), D-form (also called Y-form), and other titanyl phthalocyanines (other name: oxytitanium phthalocyanines), vanadyl phthalocyanines, chloroindium phthalocyanines, hydroxyindium phthalocyanines, II-form and other chlorogallium phthalocyanines, V-form and other hydroxygallium phthalocyanines, G-form, I-form, and other μ-oxogallium phthalocyanine dimers, and II-form and other μ-oxoaluminum phthalocyanine dimers.

Especially preferred of these phthalocyanines are A-form (also called β-form) and B-form (also called α-form) titanyl phthalocyanines, D-form (Y-form) titanyl phthalocyanine characterized by showing a distinct peak at a diffraction angle 2θ(±0.2°) of 27.1° or 27.3° in X-ray powder diffractometry, II-form chlorogallium phthalocyanine, V-form hydroxygallium phthalocyanine, hydroxygallium phthalocyanine characterized by having a most intense peak at 28.1° or characterized by having no peak at 26.2°, having a distinct peak at 28.1°, and having a half-value width W at 25.9° of 1°≤W≤0.4°, G-form μ-oxogallium phthalocyanine dimer, and the like.

A single phthalocyanine compound may be used alone, or a mixture of several phthalocyanine compounds or a phthalocyanine compound in a mixed-crystal state may be used. The state in which phthalocyanine compounds are mixed or the mixed-crystal state may be one obtained by mixing the constituent elements later, or may be one formed in steps for phthalocyanine compound production and treatments, such as synthesis, pigment formation, crystallization, etc. Known as such treatments are an acid pasting treatment, grinding treatment, solvent treatment, and the like.

Examples of methods for producing a mixed-crystal state include a method in which two kinds of crystals are mixed together and the resultant mixture is mechanically ground and made amorphous and is then subjected to a solvent treatment to thereby convert the amorphous state into a specific crystalline state, as described in JP-A-10-48859.

In the case of using an azo pigment as a charge generation substance, various bisazo pigments and trisazo pigments are suitable for use. In the case of using organic pigments as charge generation substances, one organic pigment may be used alone. However, two or more pigments may be mixed and used. In this case, it is preferred to use a combination of two or more charge generation substances which have spectral sensitivity characteristics in different spectral regions, i.e., the visible region and the near infrared region. More preferred of such combinations is to use a disazo or trisazo pigment and a phthalocyanine pigment in combination.

The binder resin to be used in the charge generation layer is not particularly limited. Examples thereof include insulating resins such as poly(vinyl acetal)-based resins, e.g., poly(vinyl butyral) resins, poly(vinyl formal) resins, and partly acetalized poly(vinyl butyral) resins in which some of the butyral moieties have been modified with formal, acetal, or the like, polyarylate resins, polycarbonate resins, polyester resins, modified ether-based polyester resins, phenoxy resins, poly(vinyl chloride) resins, poly(vinylidene chloride) resins, poly(vinyl acetate) resins, polystyrene resins, acrylic resins, methacrylic resins, polyacrylamide resins, polyamide resins, polyvinylpyridine resins, cellulosic resins, polyurethane resins, epoxy resins, silicone resins, poly(vinyl alcohol) resins, polyvinylpyrrolidone resins, casein, copolymers based on vinyl chloride and vinyl acetate, e.g., vinyl chloride/vinyl acetate copolymers, hydroxy-modified vinyl chloride/vinyl acetate copolymers, carboxyl-modified vinyl chloride/vinyl acetate copolymers, and vinyl chloride/vinyl acetate/maleic anhydride copolymers, styrene/butadiene copolymers, vinylidene chloride/acrylonitrile copolymers, styrene/alkyd resins, silicone/alkyd resins, and phenol/formaldehyde resins, and organic photoconductive polymers such as poly(N-vinylcarbazole), polyvinylanthracene, and polyvinylperylene. Any one of these binder resins may be used alone, or any desired combination of two or more thereof may be used as a mixture thereof.

Specifically, the charge generation layer may be formed by dissolving the binder resin in an organic solvent, dispersing a charge generation substance in the resultant solution to prepare a coating fluid, and applying this coating fluid to a conductive support (or to an undercoat layer in the case where the undercoat layer has been disposed).

With respect to the ratio (by mass) between the binder resin and the charge generation substance in the charge generation layer, the amount of the charge generation substance per 100 parts by mass of the binder resin is usually 10 parts by mass or larger, preferably 30 parts by mass or larger, and is usually 1,000 parts by mass or less, preferably 500 parts by mass or less.

The thickness of the charge generation layer is usually 0.1 μm or larger, preferably 0.15 μm or larger, and is usually 10 μm or less, preferably 0.6 μm or less. In case where the proportion of the charge generation substance is too high, there is a possibility that the coating fluid might have reduced stability due to agglomeration of the charge generation substance, etc. Meanwhile, in case where the proportion of the charge generation substance is too low, there is a possibility that the photoreceptor might have reduced sensitivity.

For dispersing the charge generation substance, a known dispersion method can be used, such as a ball-mill dispersion method, attritor dispersion method, sand-mill dispersion method, or bead-mill dispersion. In this case, it is effective to finely pulverize the particles to a particle size in the range of up to 0.5 μm, preferably up to 0.3 μm, more preferably up to 0.15 μm.

<Charge Transport Layer>

The charge transport layer of the multilayer type photoreceptor contains a charge transport substance and usually includes a binder resin and other ingredients which are used according to need. The charge transport layer can specifically be obtained, for example, by dissolving or dispersing a charge transport substance, etc. and a binder resin in a solvent to produce a coating fluid, applying this coating fluid to the charge generation layer in the case of a normal-stack type photosensitive layer or to a conductive support in the case of a reverse-stack type photosensitive layer (or to an undercoat layer in the case where the undercoat layer has been disposed), and drying the coating fluid applied.

Although use of charge transport substance including a compound represented by formula (1) is essential in the invention, other charge transport substances may be mixed therewith and used. The charge transport substances which may be mixed and used are not particularly limited, and any desired substances can be used.

Known examples of such other charge transport substances include: electron-attracting substances such as aromatic nitro compounds, e.g., 2,4,7-trinitrofluorenone, cyano compounds, e.g., tetracyanoquinodimethane, and quinone compounds, e.g., diphenoquinone; and electron-donating substances such as heterocyclic compounds, e.g., carbazole derivatives, indole derivatives, imidazole derivatives, oxazole derivatives, pyrazole derivatives, thiadiazole derivatives, and benzofuran derivatives, aniline derivatives, hydrazone derivatives, aromatic amine derivatives, stilbene derivatives, butadiene derivatives, and enamine derivatives, and compounds each made up of two or more of these compounds bonded together or polymers each including, in the main chain or a side chain thereof, a group constituted of any of these compounds.

Preferred of these are carbazole derivatives, aromatic amine derivatives, stilbene derivatives, butadiene derivatives, enamine derivatives, and compounds each made up of two or more of these compounds bonded together.

Specific suitable structure examples of such other charge transport substances are shown below. The following examples are mere examples, and any known charge transport substance may be used so long as the use thereof does not depart from the spirit of the invention. Any one of these charge transport substances may be used alone, or any desired two or more thereof may be used in combination.

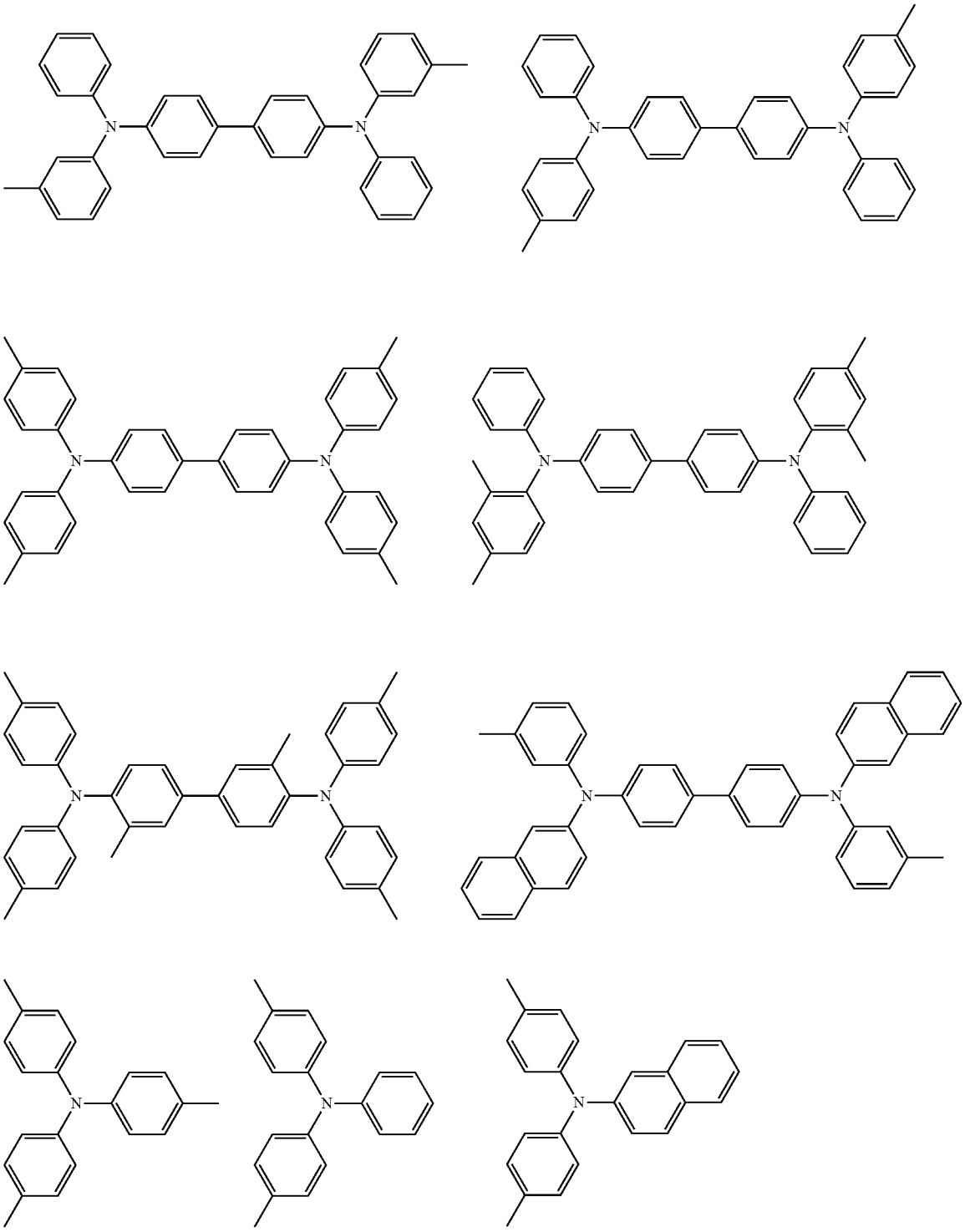

-continued
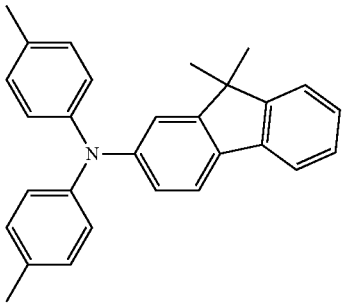
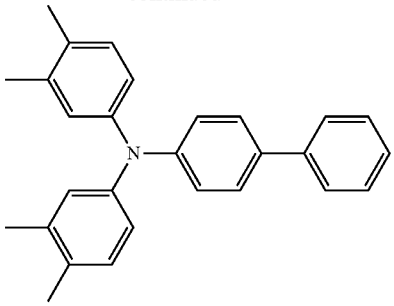
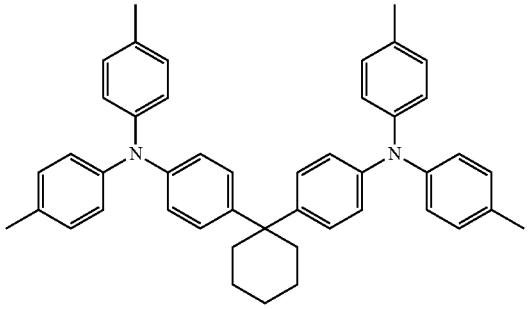
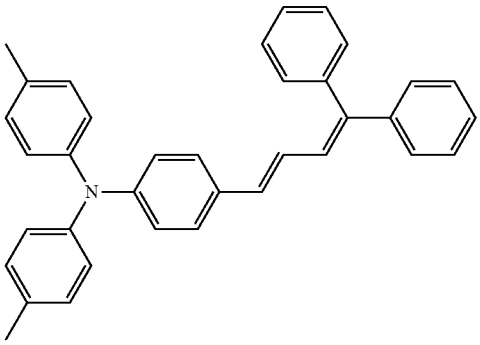
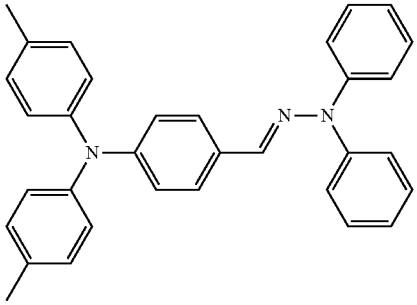
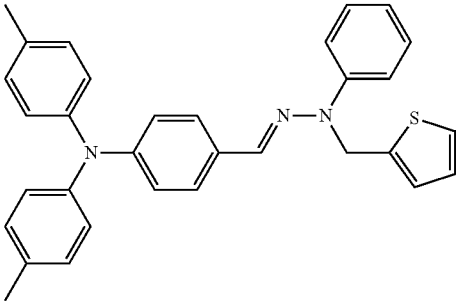
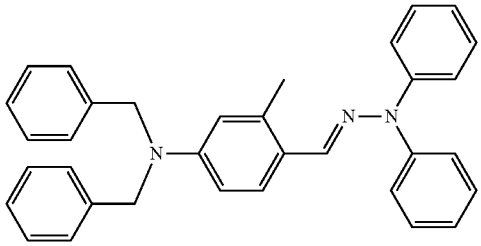
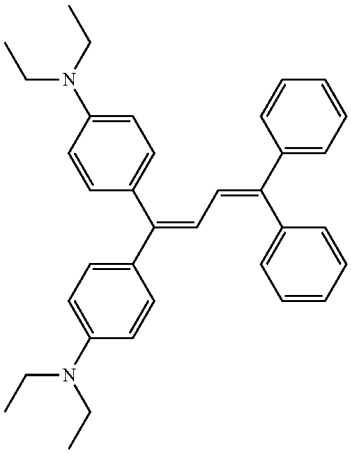

-continued
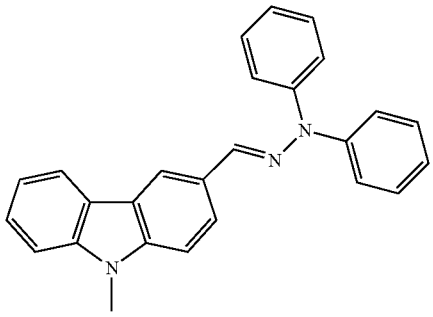
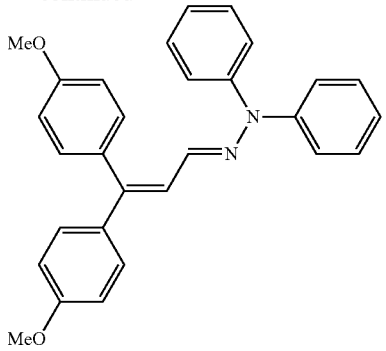
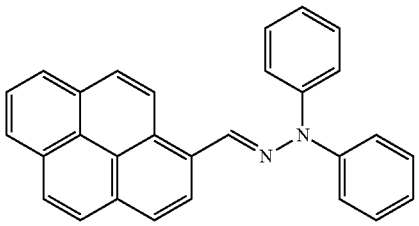
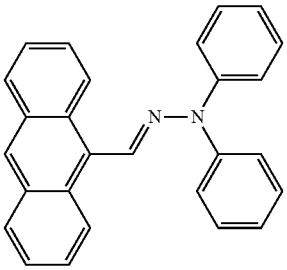
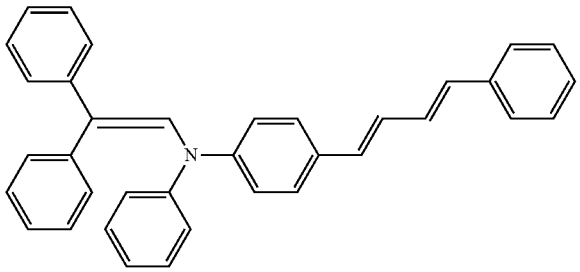
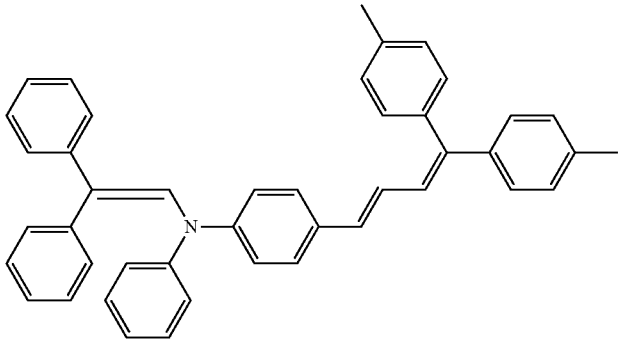
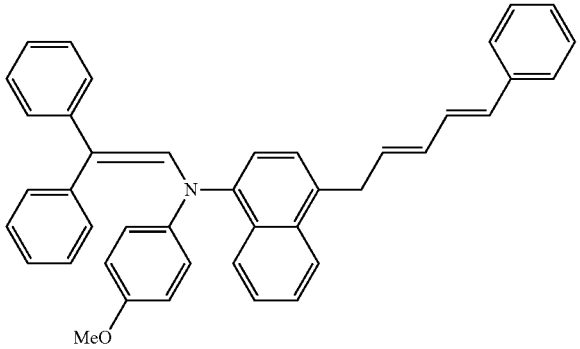
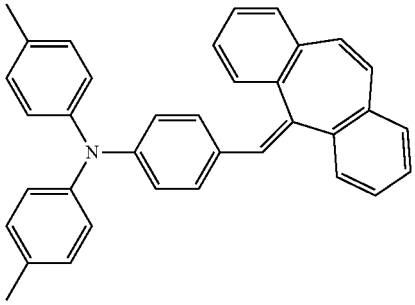

-continued
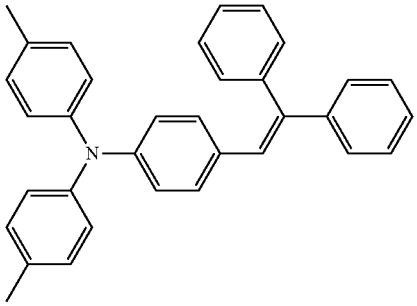
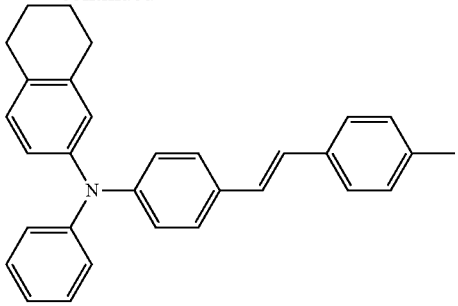
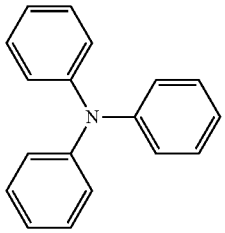
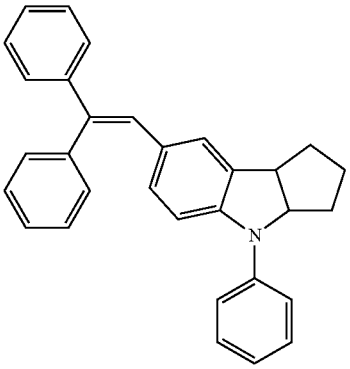
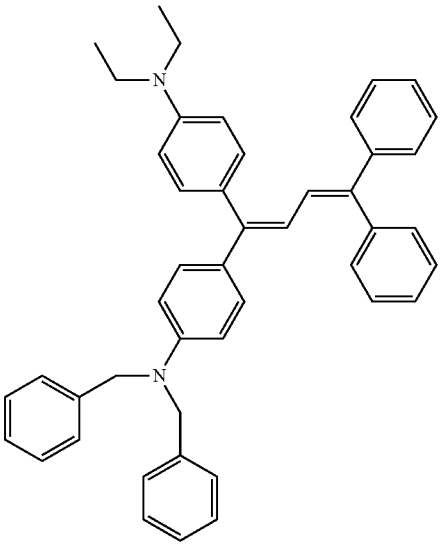
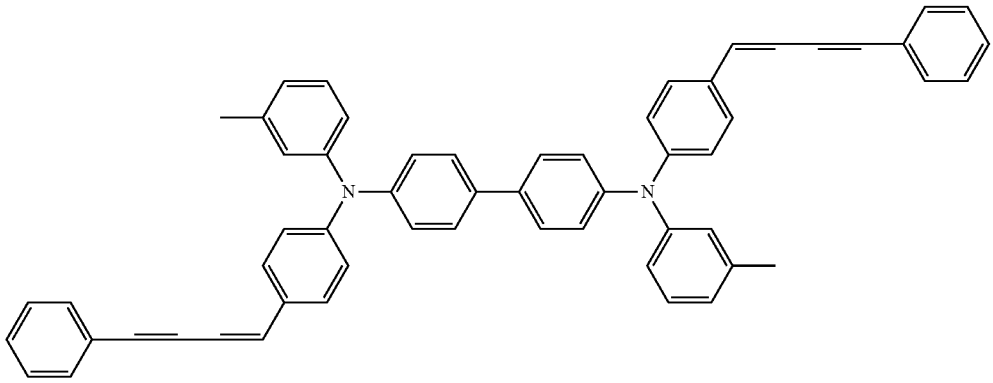
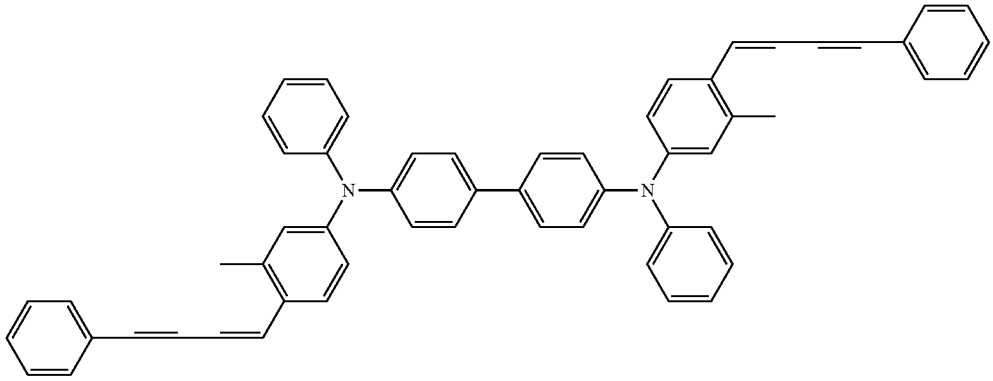

-continued
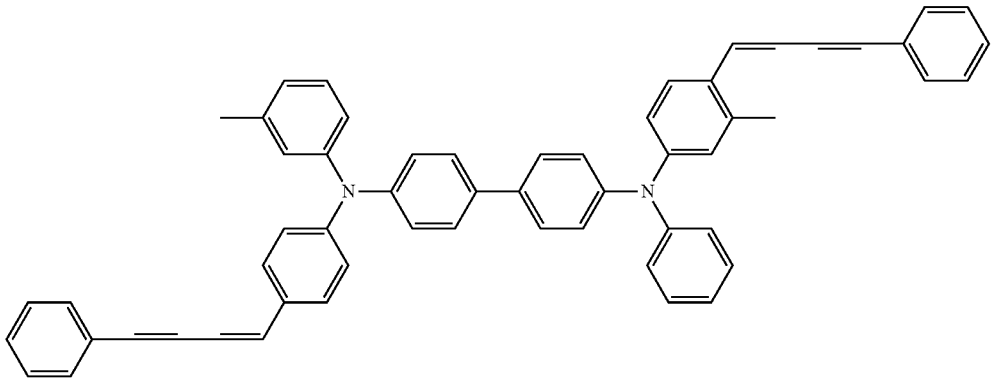
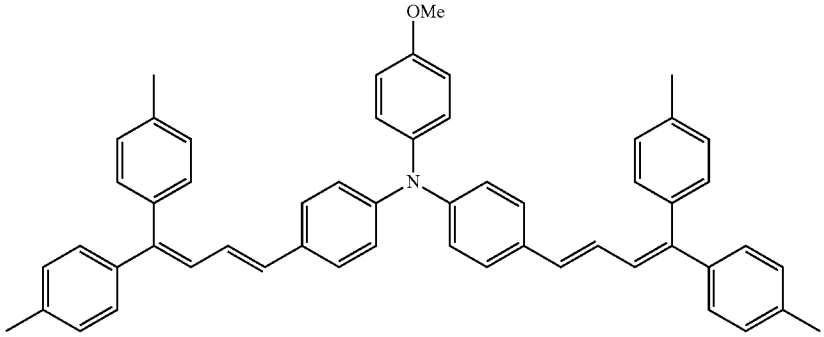
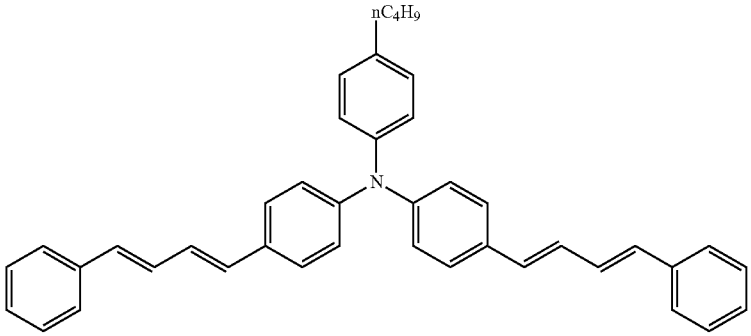
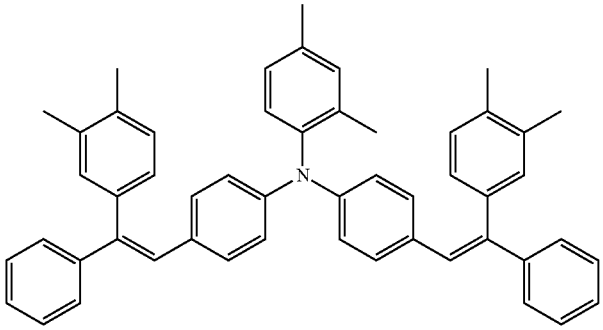

-continued
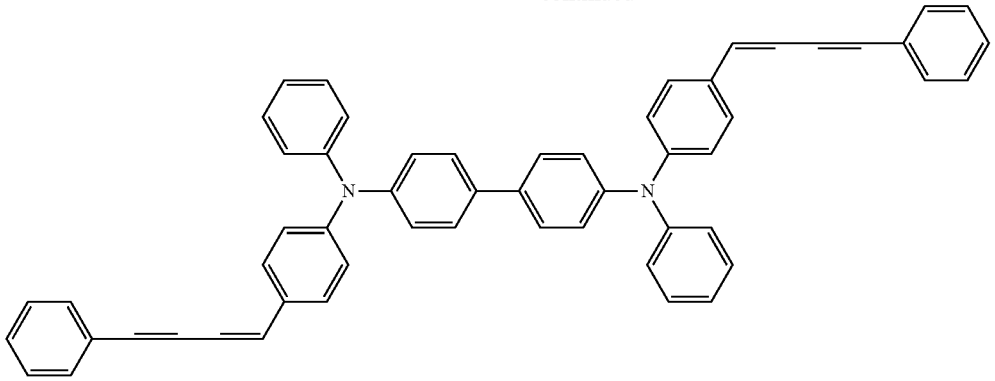
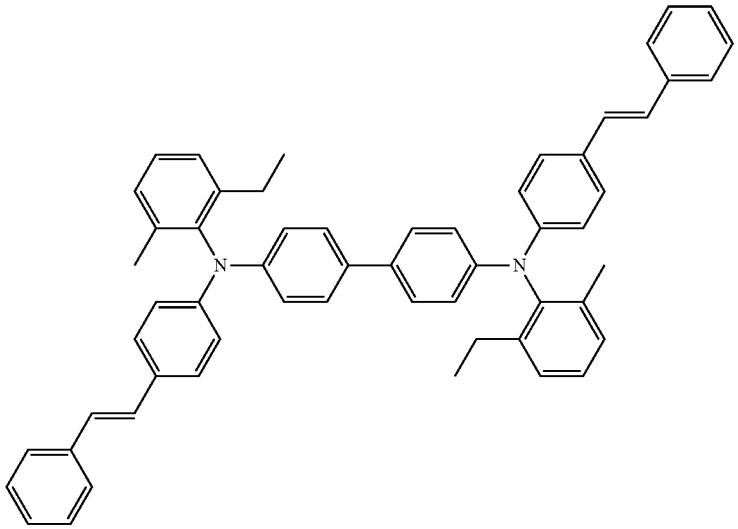
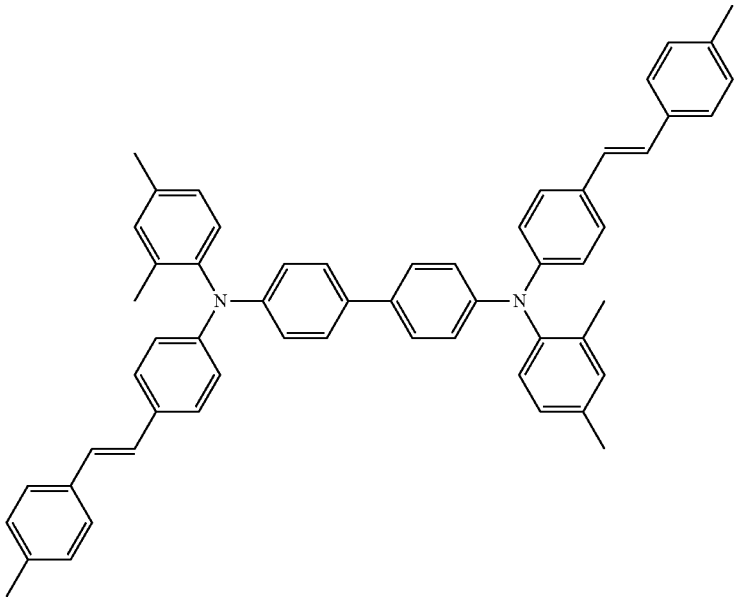

-continued
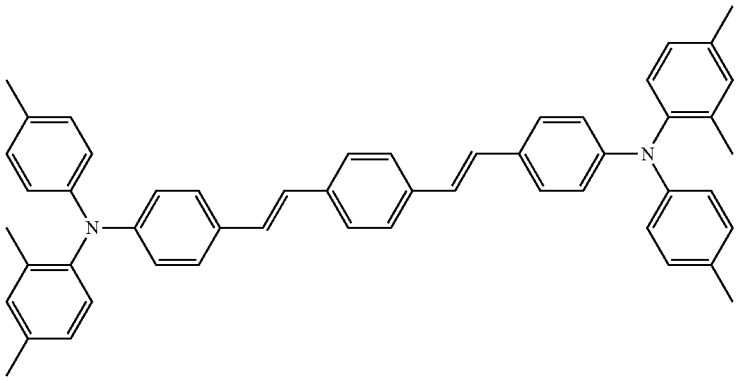
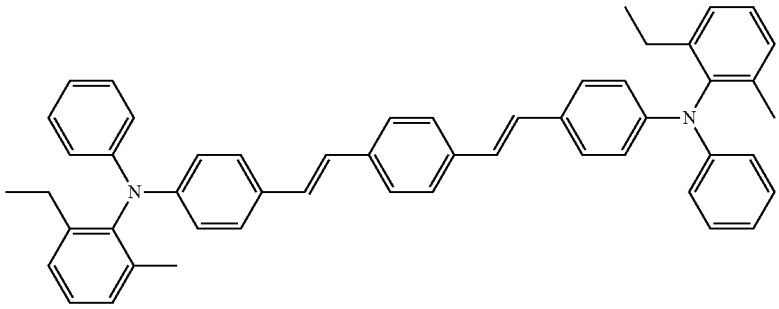
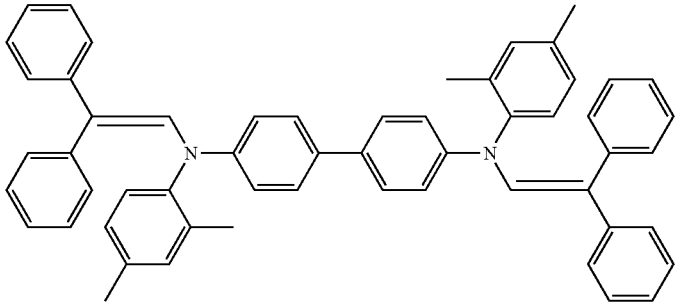
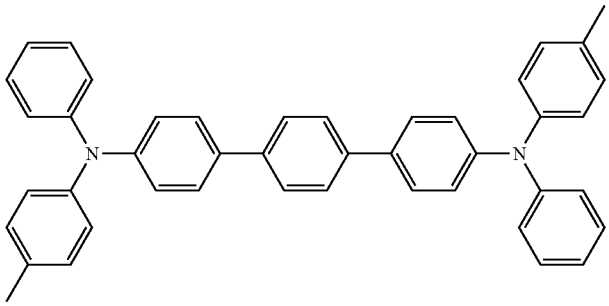
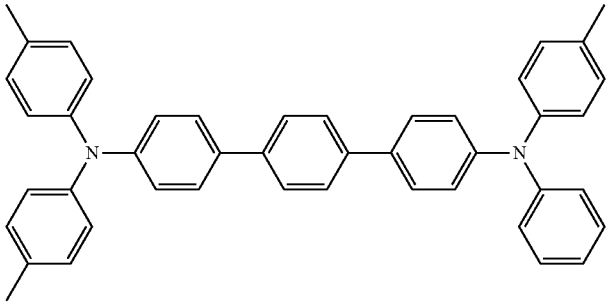

-continued

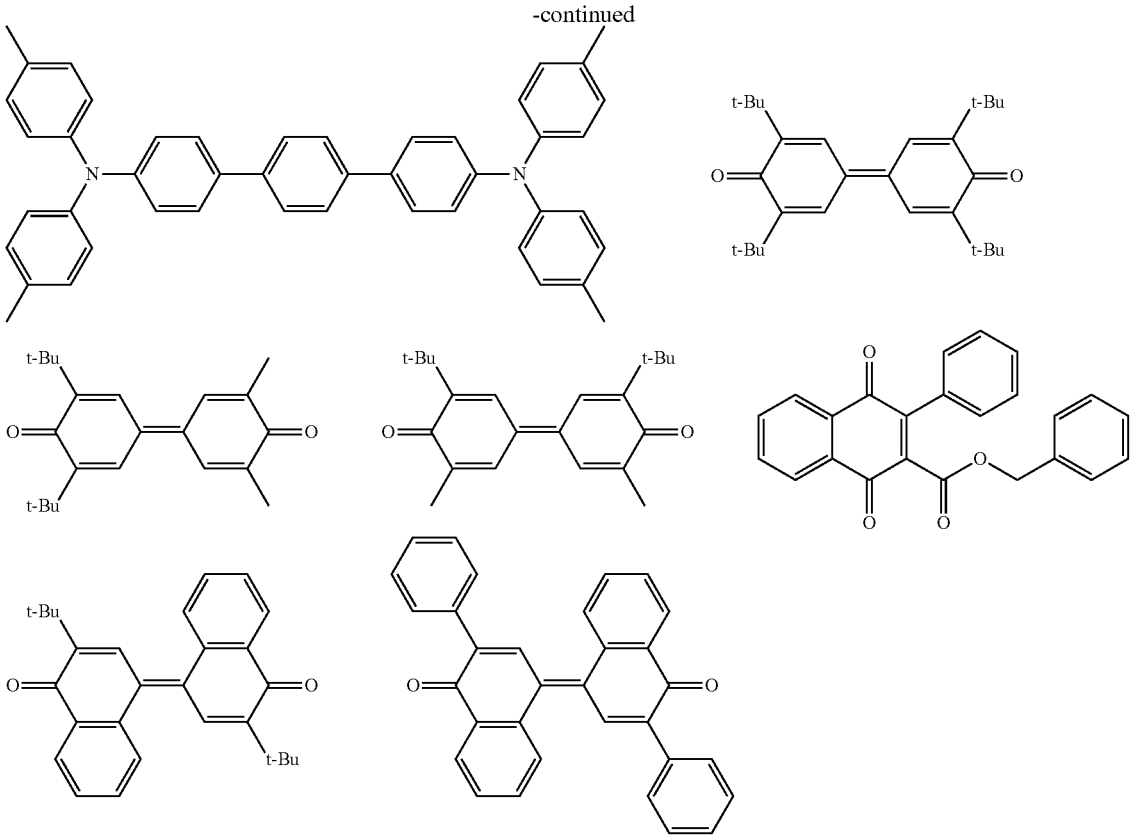

Examples of the binder resin include thermoplastic resins and various thermosetting resins, such as vinyl polymers, e.g., poly(methyl methacrylate), polystyrene, and poly(vinyl chloride), copolymers thereof, and polycarbonate, polyester, polyester/polycarbonate, polysulfone, phenoxy, epoxy, and silicone resins. Preferred of these resins are polycarbonate resins or polyester resins.

Specific suitable structure examples of the binder resin are shown below. However, the following are mere examples, and any known binder resin may be mixed and used so long as the use thereof does not depart from the spirit of the invention.

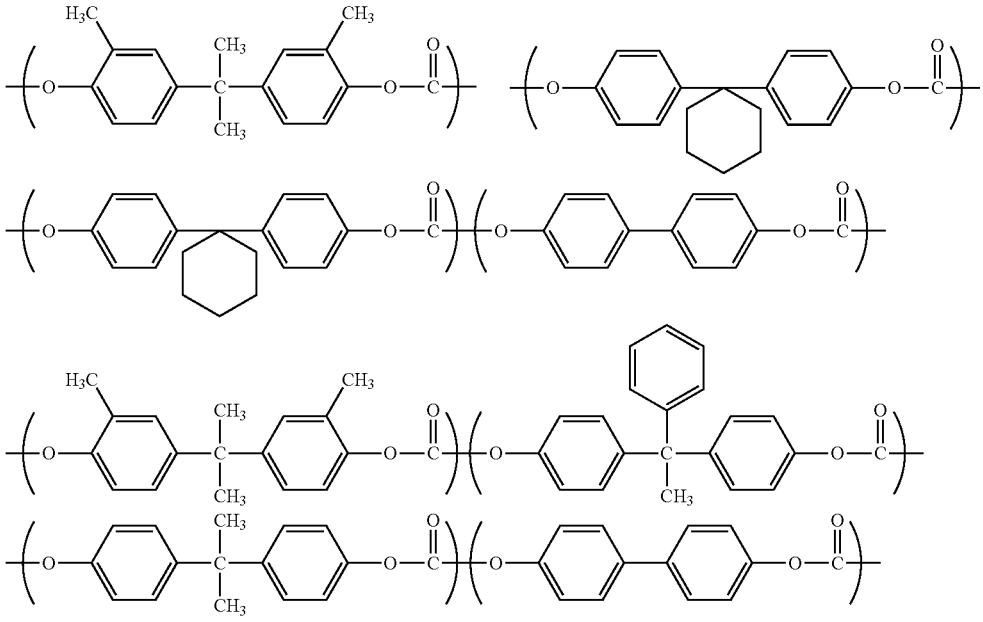

-continued

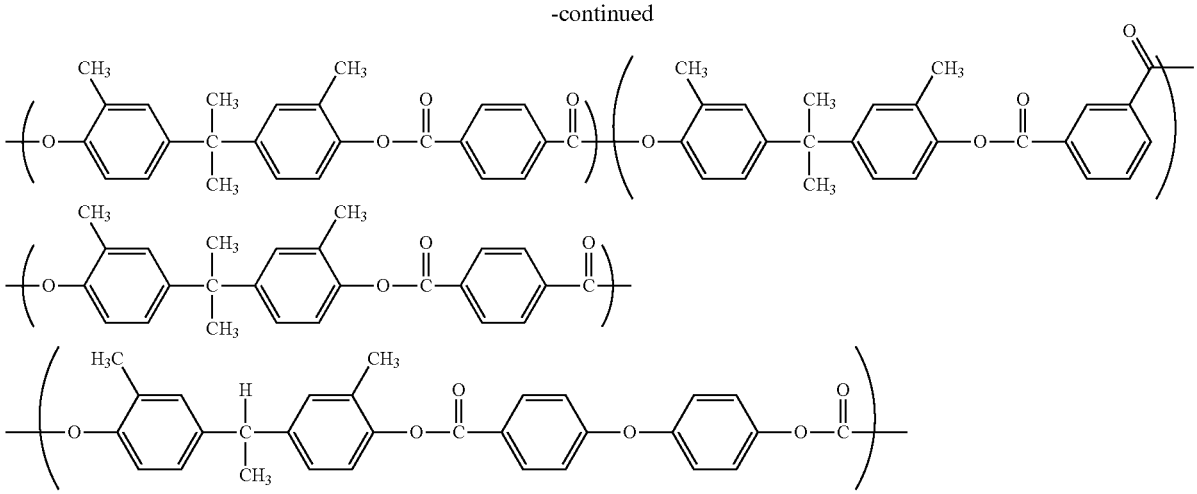

The binder resin may have any desired viscosity-average molecular weight unless the effect of the invention is considerably lessened thereby. However, the viscosity-average molecular weight thereof is usually 20,000 or higher, and is preferably 40,000 or higher from the standpoint of wear resistance. Meanwhile, the viscosity-average molecular weight thereof is usually 150,000 or less, and is preferably 120,000 or less, more preferably 100,000 or less, from the standpoint of applicability.

Compounds represented by formula (1) show poor solubility due to the enhanced π-conjugation thereof, and a resin having a high viscosity-average molecular weight is not usually used therefor. However, by regulating the purity of the charge transport substance and selecting a coating-fluid solvent from the following to configure a preferred mode in order to accommodate the photoreceptor to high-end machines, the photoreceptor can be made to withstand practical use.

Examples of the solvent to be used for producing the coating fluid for charge transport layer formation include: saturated aliphatic solvents such as pentane, hexane, octane, and nonane; aromatic hydrocarbon solvents such as toluene, xylene, and anisole; halogenated aromatic solvents such as chlorobenzene, dichlorobenzene, and chloronaphthalene; amide solvents such as dimethylformamide and N-methyl-2-pyrrolidone; alcohol solvents such as methanol, ethanol, isopropanol, n-butanol, and benzyl alcohol; aliphatic polyhydric alcohols such as glycerin and polyethylene glycol; ketone solvents such as acetone, cyclohexanone, methyl ethyl ketone, and 4-methoxy-4-methyl-2-pentanone; ester solvents such as methyl formate, ethyl acetate, and n-butyl acetate; halogenated hydrocarbon solvents such as methylene chloride, chloroform, and 1,2-dichloroethane; ether solvents such as diethyl ether, dimethoxyethane, tetrahydrofuran, 1,4-dioxane, methyl Cellosolve, ethyl Cellosolve, and anisole; aprotic polar solvents such as acetonitrile, dimethyl sulfoxide, sulfolane, and hexamethylphosphoric triamide; nitrogen-containing compounds such as n-butylamine, isopropanolamine, diethylamine, triethanolamine, ethylenediamine, triethylenediamine, and triethylamine; mineral oils such as ligroin; and water. Preferred from the standpoint of electrical property are halogen-free solvents each having no halogen atom in the structure.

Any one of these solvents may be used alone, or any desired two or more thereof may be used in combination in any desired proportion. Preferred of those solvents are the following. Preferred from the standpoint of the solubility of materials to be used in the charge transport layer are: aromatic hydrocarbon solvents such as toluene and xylene; ketone solvents such as acetone, cyclohexanone, methyl ethyl ketone, and 4-methoxy-4-methyl-2-pentanone; ester solvents such as methyl formate, ethyl acetate, and n-butyl acetate; halogenated hydrocarbon solvents such as methylene chloride, chloroform, and 1,2-dichloroethane; and ether solvents such as diethyl ether, dimethoxyethane, tetrahydrofuran, 1,4-dioxane, methyl Cellosolve, ethyl Cellosolve, and anisole. More preferred from the standpoint of film-forming property are: aromatic solvents such as toluene, xylene, and anisole; and ether solvents such as diethyl ether, dimethoxyethane, tetrahydrofuran, 1,4-dioxane, methyl Cellosolve, ethyl Cellosolve, and anisole. From the standpoint of electrophotographic photoreceptor properties, it is more preferred to use toluene or tetrahydrofuran.

Any desired two or more kinds of solvents may be used in combination. In the case of using a mixture, it is preferred to use an ether solvent in combination with another solvent, from the standpoint of resistance to repeated transfer voltage application. From the standpoint of compatibility, aromatic hydrocarbons are preferred.

In the case of using an ether solvent and another solvent as a mixed solvent, the mass ratio therebetween [(ether solvent)/(other solvent)] is usually 1/2 or higher, preferably 1/1 or higher, more preferably 2/1 or higher, from the standpoint of resistance to repeated transfer voltage application. From the standpoint of applicability, the mass ratio is usually 15/1 or less, preferably 10/1 or less.

It is preferable that a coating fluid for photosensitive-layer formation should be prepared so that the mass ratio between the charge transport substance and the solvent [(charge transport substance)/solvent] is from 1/10 to 1/100. From the standpoint of the solubility of the charge transport substance, the mass ratio is more preferably 1/12 or less, even more preferably 1/15 or less. From the standpoint of applicability, the mass ratio is more preferably 1/90 or higher, even more preferably 1/50 or higher.

When mixing the charge transport substance with the solvent, it is preferred to dissolve the charge transport substance with heating. With respect to the temperature of the solution which is being prepared with heating, a lower limit thereof is usually 20 degrees or higher, preferably 25 degrees or higher, more preferably 30 degrees or higher, from the standpoint of solubility. From the standpoint of preventing decomposition, an upper limit of the solution temperature is usually 80 degrees or lower, preferably 70 degrees or lower, more preferably 65 degrees or lower.

For example, in the case of a single-layer type photoreceptor and in the case of the charge transport layer of a function allocation type photoreceptor, the solid concentration of the coating fluid is regulated to a value which is usually 5% by mass or higher, preferably 10% by mass or higher, and is usually 40% by mass of less, preferably 35% by mass or less. Meanwhile, the viscosity of the coating fluid as measured at the temperature during use is regulated to a value which is usually 10 mPa·s or higher, preferably 50 mPa·s or higher, and is usually 1,500 Pa·s or less, preferably 1,000 Pa·s or less, more preferably 500 mPa·s or less, even more preferably 400 mPa·s or less.

With respect to the drying of the coating fluid, it is preferable that after room-temperature drying to the touch, the coating layer should be dried with heating at a temperature in the range of 30-200° C. for a period of from 1 minute to 2 hours with or without air blowing. The heating temperature may be constant, or the heating for drying may be performed while changing the temperature.

<Single-layer Type Photosensitive Layer>

The single-layer type photosensitive layer is formed using a charge generation substance, a charge transport substance represented by formula (1) and binder resins. Specifically, the single-layer type photosensitive layer can be obtained by dissolving or dispersing a charge generation substance, the charge transport substance, and any of various binder resins in a solvent to produce a coating fluid, applying the coating fluid to a conductive support (or to an undercoat layer in the case where the undercoat layer has been disposed), and drying the coating fluid applied.

The kinds and proportions of the charge transport substance represented by formula (1) and of the binder resin are the same as in the case of the charge transport layer of the multilayer type photoreceptor. The photosensitive layer of the single-layer type photoreceptor is used in a film thickness in the range of usually 5-100 μm, preferably 10-50 μm, while the charge transport layer of the normal-stack type photoreceptor is used in a film thickness in the range of usually 5-50 μm. However, the thickness of each layer is preferably 10-45 μm from the standpoints of long life and image stability, and is more preferably 10-30 μm from the standpoint of high resolution.

<Protective Layer>

A protective layer may be disposed as an outermost layer of the photoreceptor for the purpose of preventing the photosensitive layer from being damaged or wearing or of preventing or lessening the deterioration of the photosensitive layer caused by, for example, discharge products released from the charging device, etc. The protective layer may be configured of an appropriate binder resin and a conductive material incorporated thereinto. Alternatively, use can be made of a copolymer obtained using a compound having charge-transporting ability, such as those described in JP-A-9-190004 and JP-A-10-252377, e.g., a triphenylamine framework.

As the conductive material, use can be made, for example, of an aromatic amino compound such as TPD (N,N'-diphenyl-N,N'-bis(m-tolyl)benzidine) or a metal oxide such as antimony oxide, indium oxide, tin oxide, titanium oxide, tin oxide-antimony oxide, aluminum oxide, or zinc oxide. However, the conductive material is not limited to these substances.

As the binder resin for the protective layer, use can be made of a known resin such as a polyamide resin, polyurethane resin, polyester resin, epoxy resin, polyketone resin, polycarbonate resin, poly(vinyl ketone) resin, polystyrene resin, polyacrylamide resin, or siloxane resin. Also usable is a copolymer of a framework having charge-transporting ability, such as those described in JP-A-9-190004 and JP-A-10-252377, e.g., a triphenylamine framework, with any of those resins.

It is preferable that the protective layer should be configured so as to have an electrical resistance of $10^9$-$10^{14}$ Ω·cm. In case where the electrical resistance thereof is higher than $10^{14}$ Ω·cm, the photoreceptor has an elevated residual potential to give fogged images. Meanwhile, in case where the electrical resistance thereof is lower than $10^9$ Ω·cm, image blurring and a decrease in resolution might result. The protective layer is configured so as not to substantially prevent the transmission of the light with which the photoreceptor is irradiated for imagewise exposure.

Furthermore, a fluororesin, silicone resin, polyethylene resin, polystyrene resin, or the like may be incorporated into the surface layer for the purposes of reducing the frictional resistance or wear of the photoreceptor surface, heightening the efficiency of toner transfer from the photoreceptor to a transfer belt and to paper, etc. Alternatively, the surface layer may contain particles of any of these resins or particles of an inorganic compound such as silica or alumina.

<Methods for Forming the Layers>

The photosensitive layer which constitutes the photoreceptor may be formed by repeatedly and successively performing application and drying steps, in which a coating fluid obtained by dissolving or dispersing, in an organic solvent, substances to be incorporated is applied to a conductive support by a known method, e.g., dip coating, spray coating, nozzle coating, bar coating, roll coating, or blade coating, and dried to form each layer.

Examples of the organic solvent include ether solvents such as aliphatic cyclic ethers, e.g., tetrahydrofuran, methyltetrahydrofuran, tetrahydropyran, 1,4-dioxane, and 1,3-dioxolane, aliphatic chain ethers, e.g., ethyl propyl ether, propyl ether, dibutyl ether, dimethoxyethane, and diethoxyethane, and aromatic ethers, e.g., anisole, methoxytoluene, and phenetole, alcohols such as methanol, ethanol, propanol, and 2-methoxyethanol, esters such as methyl formate and ethyl acetate, ketones such as acetone, methyl ethyl ketone, cyclohexanone, and 4-methoxy-4-methyl-2-pentanone, aromatic hydrocarbons such as benzene, toluene, and xylene, chlorinated hydrocarbons such as dichloromethane, chloroform, 1,2-dichloroethane, 1,1,2-trichloroethane, 1,1,1-trichloroethane, tetrachloroethane, 1,2-dichloropropane, and trichloroethylene, nitrogen-containing compounds such as n-butylamine, isopropanolamine, diethylamine, triethanolamine, ethylenediamine, and triethylenediamine, and aprotic polar solvents such as acetonitrile, N-methylpyrrolidone, N,N-dimethylformamide, and dimethyl sulfoxide.

Preferred of these are aliphatic cyclic ethers, aromatic ethers, and aromatic hydrocarbons, from the standpoint of the property of forming the photosensitive layer. More preferred from the standpoint of resistance to repeated transfer voltage application are tetrahydrofuran, 1,3-dioxolane, anisole, and toluene.

In the case of the charge generation layer of the multilayer type photoreceptor, the solid concentration of the coating fluid is regulated to a value which is usually 0.1% by mass or higher, preferably 1% by mass or higher, and is usually 15% by mass or less, preferably 10% by mass or less.

Meanwhile, the viscosity of the coating fluid as measured at the temperature during use is regulated to a value which is usually 0.01 mPa·s or higher, preferably 0.1 mPa·s or higher, and is usually 20 mPa·s or less, preferably 10 mPa·s or less.

Examples of methods for applying the coating fluid include dip coating, spray coating, spinner coating, bead coating, wire-wound bar coating, blade coating, roller coating, air-knife coating, and curtain coating. However, it is also possible to use other known coating techniques.

With respect to the drying of the coating fluid, it is preferable that after room-temperature drying to the touch, the coating layer should be dried with heating usually at a temperature in the range of 30-200° C. for a period of from 1 minute to 2 hours either in a stationary atmosphere or with air blowing. The heating temperature may be constant, or the heating for drying may be performed while changing the temperature.

<Cartridge and Image Forming Apparatus>

Next, a drum cartridge and an image forming apparatus which each employ the electrophotographic photoreceptor of the invention are explained on the basis of FIG. 1, which shows an example of the apparatus.

In FIG. 1, numeral 1 denotes a drum-shaped photoreceptor, which is rotated in the direction of the arrow at a given peripheral speed. While the photoreceptor 1 is being rotated, the surface thereof is evenly charged with a charging device 2 to a positive or negative, given potential and is subsequently subjected to exposure for latent-image formation by an imagewise-exposure means in an exposure device 3.

The electrostatic latent image formed is then developed with a toner by a developing device 4, and the toner image formed by the development is successively transferred by a transfer device 5 to recording paper P supplied from a paper feeder.

In FIG. 1, the developing device 4 includes a developing vessel 41, agitators 42, a feed roller 43, a developing roller 44, and a control member 45, and has been configured so that a toner T is retained in the developing vessel 41. According to need, a replenisher (not shown) for replenishing with toner T may be provided to the developing device 4. This replenisher is configured so that the developing device 4 can be replenished with toner T from a vessel such as a bottle or a cartridge.

The receiving object to which the image has been transferred is then sent to a fixing device 7, where the image is fixed. The printed paper is then discharged from the machine. The fixing device 7 is configured of an upper fixing member (fixing roller) 71 and a lower fixing member (fixing roller) 72, and a heater 73 has been provided to the inside of the upper or lower fixing member 71 or 72. FIG. 1 shows an example in which a heater 73 has been provided to the inside of the upper fixing member 71.

As each of the upper and lower fixing members 71 and 72, use can be made of a known thermal fixing member such as a fixing roll obtained by coating a pipe of a metal such as stainless steel or aluminum with a silicone rubber, a fixing roll obtained by further coating with a Teflon (registered trademark) resin, or a fixing sheet. Furthermore, the fixing members 71 and 72 each may be configured so that a release agent such as a silicone oil is supplied thereto in order to improve the releasability, or may be configured so that the fixing members are forcedly pressed against each other with springs or the like.

The toner transferred to the recording paper P passes through the nip between the upper fixing member 71 heated at a given temperature and the lower fixing member 72, during which the toner is heated until the toner comes into a molten state. After the passing, the toner is cooled and fixed to the surface of the recording paper P.

The surface of the photoreceptor 1, after the image transfer, is cleaned with a cleaning device 6 to remove any toner remaining untransferred, and the residual charges are eliminated by a charge eraser. Thus, the surface of the photoreceptor 1 is cleaned in preparation for next image formation.

When using the electrophotographic photoreceptor of the invention, the charging device to be used may be a corona charging device, such as a corotron or a scorotron, or a direct charging means in which a direct charging member to which a voltage is being applied is brought into contact with the photoreceptor surface to thereby charge the surface.

Examples of the direct charging means include contact charging devices such as charging rollers and charging brushes. As the direct charging means, use can be made of either one which is accompanied with aerial discharge of injection charging which is not accompanied with aerial discharge. As the voltage to be applied for the charging, a direct-current voltage only can be used or an alternating current superimposed on a direct current is also usable.

For the exposure, use may be made of a halogen lamp, fluorescent lamp, laser (semiconductor or He—Ne), LED, internal photoreceptor exposure technique, or the like. However, it is preferred to use a laser, LED, optical-shutter array, or the like in a digital electrophotographic technique. With respect to wavelength, use can be made of not only monochromatic light of 780 nm or monochromatic light having a slightly short wavelength in the range of 600-700 nm.

In the development step, use may be made of a dry development technique such as cascade development, development with a one-component insulated toner, development with a one-component conductive toner, or two-component magnetic-brush development, a wet development technique, or the like.

As the toner, use can be made of chemical toners produced by suspension granulation, suspension polymerization, emulsion polymerization aggregation method, or the like, besides pulverization toners. Especially in the case of chemical toners, small-diameter toners having a particle diameter of around 4-8 μm are usable, and the toner particles can have shapes ranging from ones which are approximately spherical to ones which are not spherical, e.g., potato shape. Polymerization toners are excellent in terms of evenness in charging and transferability, and are suitable for an increase in image quality.

In the transfer step, use may be made of an electrostatic transfer technique, pressure transfer technique, adhesive transfer technique, or the like, such as corona transfer, roller transfer, or belt transfer. For the fixing, use may be made, for example, of hot-roller fixing, flash fixing, oven fixing, pressure fixing, IH fixing, belt fixing, IHF fixing, or the like. These fixing techniques may be used alone, or a plurality of fixing techniques may be used in combination.

For the cleaning, use may be made, for example, of a brush cleaner, magnetic brush cleaner, electrostatic brush cleaner, magnetic roller cleaner, blade cleaner, or the like.

The erase step is omitted in many cases. In the case of performing the step, use may be made of a fluorescent lamp, LED, or the like. With respect to intensity, an exposure energy which is at least 3 times that of the exposure light is frequently used. The apparatus may include processes of a pre-exposure step and an auxiliary charging step besides those processes.

In the invention, two or more of the constituent elements including the drum-shaped photoreceptor 1, charging device 2, developing device 4, and cleaning device 6 may be united and combined to configure a drum cartridge so that this drum cartridge can be mounted on and demounted from the main body of an electrophotographic apparatus such as a copier or a laser-beam printer. For example, at least one of the charging device 2, developing device 4, and cleaning device 6 can be integrally supported together with the drum-shaped photoreceptor 1 to configure a cartridge.

With respect to color images, toners of magenta, yellow, cyan, and black colors are superposed in multiple layers so as to result in desired colors. Thus, a full-color image can be obtained. In the case of tandem-mode development, it is preferable that the color development parts should be located before the black development part. This is because color mixing caused by, for example, reverse transfer of the black toner is slight, and because this configuration in which the black development part is located after the color development parts has advantages in that in the case of forming images of a black color only, color mixing of the color toners due to photoreceptor fogging is slight and that the speed of black image formation can be heightened by conveying sheets of recording paper so as to pass through the color development parts.

In the case of applying the photoreceptor of the invention to full-color image formation, the photoreceptor is suitable for such tandem-mode development in which color development parts for cyan, magenta, and yellow are located before and the black development part is located after the color development parts. Incidentally, the order in which the color development parts for cyan, magenta, and yellow are located can be suitably changed at will.

EXAMPLES

Modes for carrying out the invention will be explained below in more detail by reference to Examples. However, the following Examples are merely for explaining the present invention in detail, and the invention should not be construed as being limited to the following Examples and can be modified at will unless the modifications depart from the spirit of the invention. In the following Examples and Comparative Examples, the term "parts" means "parts by mass" unless otherwise indicated.

<Production of Charge Transport Substances Represented by Formula (1)>

Production Example 1

Crude CT1

The charge transport substance having the structural formula represented by the following formula (CT1) was produced in accordance with the following scheme A. The detailed conditions are as shown below.

<Scheme A>

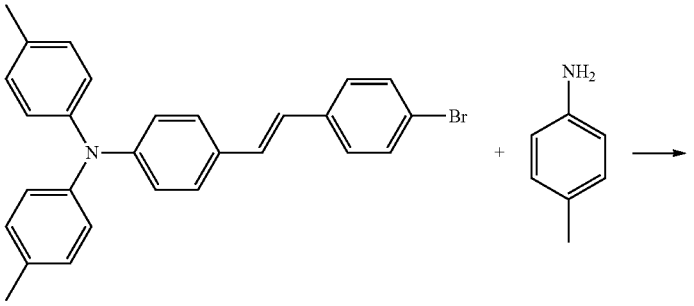

Compound A

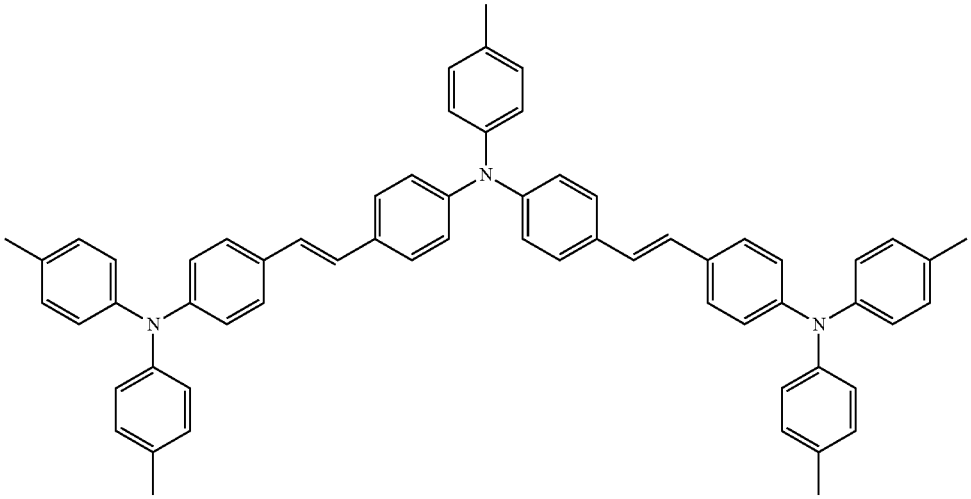

CT1

Into 500 mL of xylene were introduced 23.5 g of compound A, which is a triphenylamine derivative, 2.7 g of p-toluidine, 10.6 g of sodium t-butoxide, 500 mg of palladium acetate, and 20 mL of a 0.6 mmol/L toluene solution of tricyclohexylphosphine. The contents were heated to refluxing. After the heating, the contents were stirred and reacted for 3 hours. After completion of the reaction, the reaction solution was cooled to room temperature, and 250 mL of water was added thereto. This mixture was stirred for 30 minutes. After the stirring, the aqueous layer was separated. The organic layer was washed with deionized water and then concentrated, and the concentration residue was dissolved in tetrahydrofuran to thereby prepare a tetrahydrofuran solution of crude CT1. This solution was added to methanol, and the resultant mixture was stirred and then subjected to filtration and drying. Thus, charge transport substance CT1 in a crude state was obtained in an amount of 18.4 g. (Yield, 85.4%)

Production Example 2

A 10-g portion of the crude charge transport substance CT1 obtained in Production Example 1 was dissolved in 100 g of toluene, thereby preparing a toluene solution of the crude CT1. Five grams of activated clay was added to the toluene solution, and the resultant mixture was stirred and then filtered. This purification with activated clay [treatment with adsorbent and filtration] was repeatedly performed three times, and the resultant purified solution was concentrated. The concentration residue was dissolved in tetrahydrofuran, and this solution was added to methanol to solidify the purified compound by the reprecipitation method. After the mixture was stirred, the solid was taken out by filtration and dried. Thus, charge transport substance CT1 was obtained in an amount of 9.3 g. The palladium content in the CT1 obtained was ascertained by ICP emission spectrometry and, as a result, was found to be 83 ppm.

Production Example 3

The same procedure as in Production Example 2 was conducted, except that when the purification [treatment with adsorbent and filtration] was repeatedly performed three times, the 5 g of activated clay to be used in the second treatment was replaced with 2.0 g of Florisil. Thus, charge transport substance CT1 was obtained in an amount of 9.4 g. The palladium content in the CT1 obtained was ascertained by ICP emission spectrometry and, as a result, was found to be 41 ppm.

Production Example 4

The same procedure as in Production Example 2 was conducted, except that when the purification [treatment with adsorbent and filtration] was repeatedly performed three times, the 5 g of activated clay to be used in the second treatment was replaced with 1.5 g of activated carbon. Thus, charge transport substance CT1 was obtained in an amount of 9.3 g. The palladium content in the CT1 obtained was ascertained by ICP emission spectrometry and, as a result, was found to be 117 ppm.

Production Example 5

The same procedure as in Production Example 2 was conducted, except that when the purification [treatment with adsorbent and filtration] was repeatedly performed three times, the 5 g of activated clay to be used in the second treatment was replaced with 2.0 g of silica gel. Thus, charge transport substance CT1 was obtained in an amount of 9.3 g. The palladium content in the CT1 obtained was ascertained by ICP emission spectrometry and, as a result, was found to be 112 ppm.

Production Example 6

The charge transport substance having the structural formula represented by the following formula (CT2) was produced in accordance with the following scheme B. The detailed conditions are as shown below.

<Scheme B>

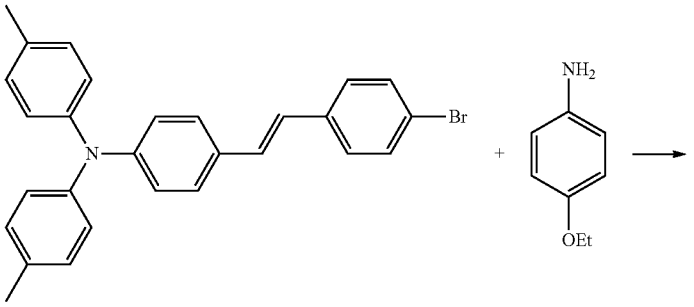

Compound A

-continued

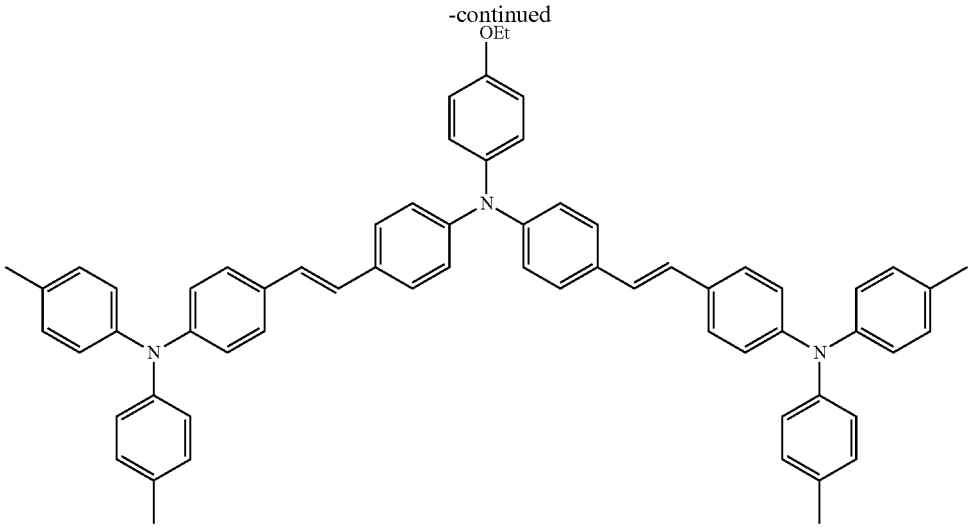

CT2

Into 500 mL of xylene were introduced 18.8 g of compound A, which is a triphenylamine derivative, 2.8 g of p-phenetidine, 8.5 g of sodium t-butoxide, 100 mg of palladium acetate, and 16 mL of a 0.6 mmol/L toluene solution of tricyclohexylphosphine. The contents were heated to refluxing. After the heating, the contents were stirred and reacted for 3 hours. After completion of the reaction, the reaction solution was cooled to room temperature, and 200 mL of water was added thereto. This mixture was stirred for 30 minutes. After the stirring, the aqueous layer was separated. The organic layer was washed with deionized water and then concentrated, and the concentration residue was dissolved in tetrahydrofuran to thereby prepare a tetrahydrofuran solution of crude CT2. This solution was added to methanol, and the resultant mixture was stirred and then subjected to filtration and drying. Thus, charge transport substance CT2 in a crude state was obtained in an amount of 13.7 g. (Yield, 75.8%)

A 10-g portion of the crude charge transport substance CT2 obtained was treated in the same manner as in Production Example 2. Thus, charge transport substance CT2 was obtained in an amount of 9.1 g. The palladium content in the CT2 obtained was ascertained by ICP emission spectrometry and, as a result, was found to be 14 ppm.

Comparative Production Example 1

A 10-g portion of the crude charge transport substance CT1 obtained in Production Example 1 was completely dissolved in 40 g of toluene with heating, and the solution was thereafter cooled to 0° C. or below. This solution in the cooled state was allowed to stand still to cause crystallization, and was then subjected to filtration and drying. Thus, charge transport substance CT1 was obtained in an amount of 6.3 g. The palladium content in the CT1 obtained was ascertained by ICP emission spectrometry and, as a result, was found to be 180 ppm.

Comparative Production Example 2

The charge transport substance having the structural formula represented by the following formula (CT1) was produced in accordance with the following scheme C. The detailed conditions are as shown below.

<Scheme C>

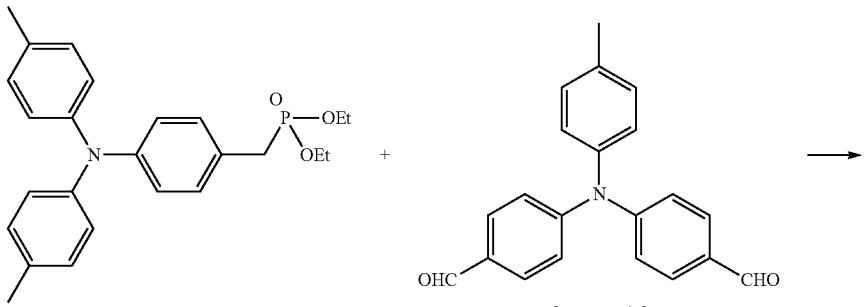

Compound B Compound C

-continued

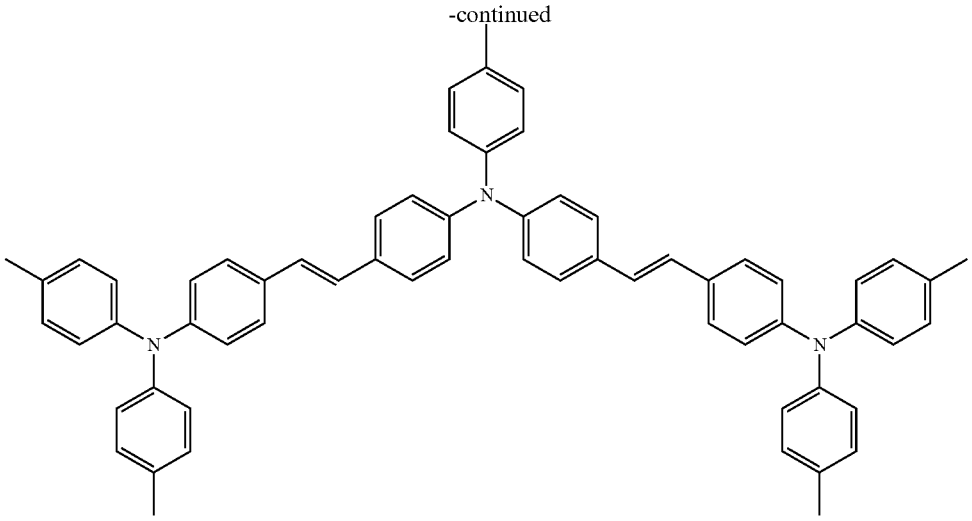

CT1

Into 300 mL of tetrahydrofuran were introduced 26.7 g of compound B and 9.5 g of compound C, which are triphenylamine derivatives. The compounds B and C were dissolved in the tetrahydrofuran. After the dissolution, 7.5 g of potassium t-butoxide was added thereto, and the mixture was stirred at room temperature for 2 hours. After completion of the reaction, the reaction solution was added to 1,000 mL of methanol, and this mixture was stirred for 30 minutes. After the stirring, the mixture was subjected to filtration and drying. Thus, charge transport substance CT1 in a crude state was obtained in an amount of 17.5 g (yield, 68.3%).

A 10-g portion of the crude charge transport substance CT1 obtained was treated in the same manner as in Production Example 2. Thus, charge transport substance CT1 was obtained in an amount of 8.3 g. The palladium content in the CT1 obtained was ascertained by ICP emission spectrometry and, as a result, palladium was not detected.

<Production of Coating Fluid for Undercoat Layer Formation>

One kilogram of a raw-material slurry obtained by mixing 120 parts of methanol with 50 parts of surface-treated titanium oxide obtained by mixing rutile titanium oxide having an average primary-particle diameter of 40 nm ("TTO55N", manufactured by Ishihara Sangyo Co., Ltd.) with methyldimethoxysilane ("TSL8117", manufactured by Toshiba Silicone Co., Ltd.), the amount of which was 3% by mass based on the titanium oxide, by means of a Henschel mixer was subjected to a 1-hour dispersing treatment with Ultra Apex Mill (Type UAM-015), manufactured by Kotobuki Industries Co., Ltd., which had a mill capacity of about 0.15 L, using zirconia beads having a diameter of about 100 μm (YTZ, manufactured by Nikkato Corp.) as a dispersing medium, while circulating the liquid under the conditions of a rotor peripheral speed of 10 m/sec and a liquid flow rate of 10 kg/hr. Thus, a titanium oxide dispersion was produced.

The titanium oxide dispersion, a methanol/1-propanol/toluene mixed solvent, and pellets of a copolyamide were stirred and mixed, with heating, to dissolve the polyamide pellets, the copolyamide being configured of ϵ-caprolactam [compound represented by the following formula (A)]/bis(4-amino-3-methylcyclohexyl)methane [compound represented by the following formula (B)]/hexamethylenediamine [compound represented by the following formula (C)]/decamethylenedicarboxylic acid [compound represented by the following formula (D)]/octadecamethylenedicarboxylic acid [compound represented by the following formula (E)] in a molar ratio of 75%/9.5%/3%/9.5%/3%. Thereafter, the mixture was subjected to a 1-hour ultrasonic dispersing treatment with an ultrasonic oscillator having an output of 1,200 W and then filtered with a membrane filter made of PTFE and having a pore diameter of 5 μm (Mitex LC, manufactured by Advantech Co., Ltd.). Thus, a coating fluid for undercoat layer formation which contained solid components in a concentration of 18.0% by mass was produced, in which the (surface-treated titanium oxide)/copolyamide mass ratio was 3/1 and the mixed solvent had a methanol/1-propanol/toluene mass ratio of 7/1/2.

A

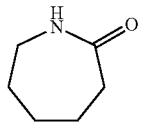

B

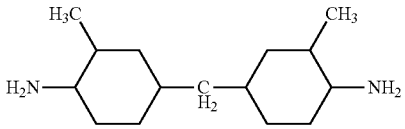

C

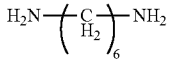

D

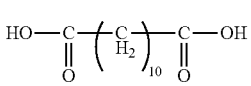

E

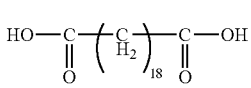

<Production of Coating Fluid for Charge Generation Layer Formation>

Twenty parts of oxytitanium phthalocyanine which showed the X-ray diffraction spectrum of FIG. 2 in an examination with CuKα characteristic X-ray was mixed, as a charge generation substance, with 280 parts of 1,2-dimethoxyethane. This mixture was subjected to 1-hour pulverization with a sand grinding mill to perform a pulverization/dispersing treatment. Subsequently, the resultant fine dispersion was mixed with a binder solution obtained by dissolving 10 parts of poly(vinyl butyral) (trade name "Denka Butyral" #6000C, manufactured by Denki Kagaku Kogyo K.K.) in a mixed liquid composed of 255 parts of 1,2-dimethoxyethane and 85 parts of 4-methoxy-4-methyl-2-pentanone, and further with 230 parts of 1,2-dimethoxyethane to prepare coating fluid A for charge generation layer formation.

Twenty parts of oxytitanium phthalocyanine which showed the X-ray diffraction spectrum of FIG. 3 in an examination with CuKα characteristic X-ray was mixed, as a charge generation substance, with 280 parts of 1,2-dimethoxyethane. This mixture was subjected to 4-hour pulverization with a sand grinding mill to perform a pulverization/dispersing treatment. Subsequently, the resultant fine dispersion was mixed with a binder solution obtained by dissolving 10 parts of poly(vinyl butyral) (trade name "Denka Butyral" #6000C, manufactured by Denki Kagaku Kogyo K.K.) in a mixed liquid composed of 255 parts of 1,2-dimethoxyethane and 85 parts of 4-methoxy-4-methyl-2-pentanone, and further with 230 parts of 1,2-dimethoxyethane to prepare coating fluid B for charge generation layer formation. Coating fluid A for charge generation layer formation was mixed with coating fluid B for charge generation layer formation in a mass ratio of 8:2 to produce a coating fluid for charge generation layer formation to be used in the Examples.

<Production of Coating Fluids for Charge Transport Layer Formation>

[Coating Fluid C1]

A hundred parts of a polyarylate resin represented by the following repeating structure (resin X; viscosity-average molecular weight, 70,000), 40 parts of the charge transport substance produced in Production Example 2, 4 parts of AD1, 1 part of AD2, 1 part of AD3, and 0.03 parts of dimethylpolysiloxane (KF96-10CS, manufactured by Shin-Etsu Chemical Co., Ltd.) were dissolved in 880 parts of a tetrahydrofuran/toluene (8/2 by mass) mixed solvent, the AD1, AD2, and AD3 being the compounds represented by the following formulae. Thus, coating fluid C1 for charge transport layer formation was prepared.

Resin X

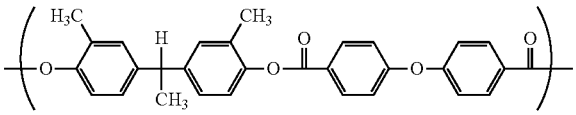

AD1

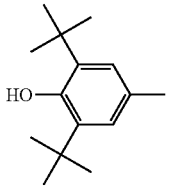

-continued

AD2

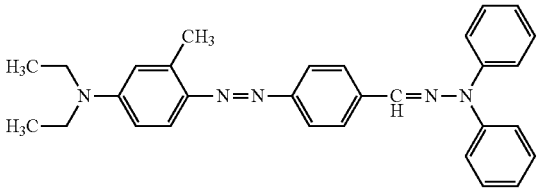

AD3

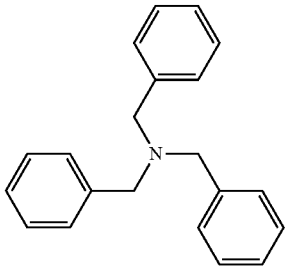

[Coating Fluids C2 to C5]

Coating fluids C2 to C5 were produced in the same manner as for coating fluid C1, except that the charge transport substances produced in Production Examples 3 to 6 were respectively used in place of the charge transport substance of Production Example 2.

[Coating Fluids C6 and C7]

Coating fluids C6 and C7 were produced in the same manner as for coating fluid C1, except that the charge transport substances produced in Comparative Production Examples 1 and 2 were respectively used in place of the charge transport substance of Production Example 2.

<Production of Photoreceptor Drums>

The coating fluid for undercoat layer formation, coating fluid for charge generation layer formation, and each coating fluid for charge transport layer formation which had been produced in the Production Examples for coating fluid production were successively applied by dip coating on an aluminum alloy cylinder in which the surface had been machined and which had an outer diameter of 60 mm, length of 248 mm, and wall thickness of 1.0 mm, in such amounts as to result in dry film thicknesses of 1.5 μm, 0.5 μm, and 21 μm, respectively, and dried to form an undercoat layer, a charge generation layer, and a charge transport layer. Thus, photoreceptor drums were produced. The drying for forming the charge transport layer was conducted at 125° C. for 24 minutes. The photosensitive layer was peeled from each photoreceptor obtained, and was analyzed by ICP emission spectrometry [apparatus: ICPS-8100S, manufactured by Shimadzu Corp.] to thereby determine the palladium content in the photosensitive layer.

<Image Test>

Each of the photoreceptors obtained was mounted in the photoreceptor cartridge of 4-cycle full-color printer CLP-320, manufactured by Samsung Co., Ltd. (DC roller charging; LD exposure; nonmagnetic one-component jumping development), and 6,000-sheet continuous printing was conducted at a coverage rate of 5% under the conditions of an air temperature of 35° C. and a relative humidity of 85%. After the 6,000-sheet printing, a half-tone image was printed and evaluated for blind spots in accordance with the following criteria.

Blind Spots

⊙: No blind spots are observed in the half-tone image.

○: No blind spots are observed in some of the half-tone image.

Δ: Slight blind spots are observed throughout the half-tone image.

×: Blind spots are clearly observed throughout the half-tone image.

<Evaluation of the Electrophotographic Photoreceptors>

The electrophotographic photoreceptors of Examples 1 to 5 and Comparative Examples 1 and 2, which are shown in Table 1, were each mounted on an apparatus for electrophotographic-property evaluation produced in accordance with the measurement standards of The Society of Electrophotography of Japan (described in The Society of Electrophotography of Japan, ed., *Zoku Denshi Shashin Gijutsu No Kiso To Ōyō,* Corona Publishing Co., Ltd., pp. 404-405, 1996), and cycling which included charging, exposure, potential measurement, and erase was performed in the following manner to thereby evaluate the electrical properties.

Under the conditions of a temperature of 25° C. and a humidity of 50%, the photoreceptor was charged so as to result in an initial surface potential of −700 V and then exposed, at an irradiation energy of 0.6 μJ/cm$^2$, to monochromatic light of 780 nm obtained from the light of a halogen lamp by means of an interference filter. Thereafter, the surface potential (unit: −V) was measured and taken as residual potential.

Examples 1 to 5 and Comparative Examples 1 and 2

The photoreceptor drums shown in Table 1 were produced and evaluated. The results thereof are shown in Table 1.

TABLE 1

| | Charge transport layer | | | | | |
|---|---|---|---|---|---|---|
| | | | Palladium content (ppm) | | | Residual |
| | CT | Coating fluid | in CT | in photosensitive layer | Blind spots | potential (−V) |
| Example 1 | Production Example 2 | C1 | 83 | 21 | ⊙ | 28 |
| Example 2 | Production Example 3 | C2 | 41 | 10 | ⊙ | 26 |
| Example 3 | Production Example 4 | C3 | 117 | 32 | ○ | 30 |
| Example 4 | Production Example 5 | C4 | 112 | 30 | ○ | 30 |
| Example 5 | Production Example 6 | C5 | 14 | 3 | ⊙ | 29 |
| Comparative Example 1 | Comparative Production Example 1 | C6 | 180 | 52 | X | 46 |
| Comparative Example 2 | Comparative Production Example 2 | C7 | 0 | 0 | Δ | 48 |

As can be seen from Table 1, use of the electrophotographic photoreceptors of the invention resulted in a low residual potential after exposure and the continuous printing performed therewith at a high temperature and a high humidity gave satisfactory results with no blind spots.

Example 6

<<Production of Electrophotographic Photoreceptor>>

<Production of Coating Fluid for Charge Generation Layer Formation>

As a charge generation substance, use was made of oxytitanium phthalocyanine crystals (showing a main diffraction peak at a Bragg angle (2θ±0.2°) of 27.2° in the X-ray diffraction spectrum obtained with CuKα characteristic X-ray). The oxytitanium phthalocyanine crystals were used in an amount of 20 parts by weight and mixed with 280 parts by weight of 1,2-dimethoxyethane. This mixture was subjected to 1-hour pulverization with a sand grinding mill to perform a pulverization/dispersing treatment, thereby obtaining a fine dispersion. Meanwhile, 20 parts by weight of poly(vinyl butyral) (trade name "Denka Butyral" #6000C, manufactured by Denki Kagaku Kogyo K.K.) was dissolved in a mixed liquid composed of 253 parts by weight of 1,2-dimethoxyethane and 85 parts by weight of 4-methoxy-4-methyl-2-pentanone, thereby preparing a binder solution.

The fine dispersion obtained by the pulverization/dispersing treatment described above was mixed with the binder solution and with 230 parts by weight of 1,2-dimethoxyethane to prepare a coating fluid for charge generation layer formation.

<Production of Coating Fluid for Charge Transport Layer Formation>

[Coating Fluid C8]

A hundred parts by weight of a polyarylate resin made up of repeating structural units of the formula (resin X) (viscosity-average molecular weight=72,000), 40 parts by weight of the charge transport material having the structure represented by formula (CT2), 4 parts by weight of the antioxidant represented by formula (AD1), 0.5 parts of the compound represented by formula (AD2), 0.1 part of the compound represented by formula (AD3), and 0.05 parts by weight of a silicone oil as a leveling agent were mixed with 1,060 parts by weight of a tetrahydrofuran/toluene mixed solvent (tetrahydrofuran, 80% by weight; toluene, 20% by weight) to prepare a coating fluid for charge transport layer formation.

<Production of Photoreceptor Drum>

A cylinder in which the surface had been roughly machined and which was made of an aluminum alloy and had an outer diameter of 30 mm, length of 246 mm, and wall thickness of 0.75 mm was anodized and thereafter subjected to a pore-filling treatment with a pore-filling agent including nickel acetate as the main component, thereby forming an anodized coating film (alumite coating film) of about 6 μm. The coating fluid for charge generation layer formation and coating fluid for charge transport layer formation which had been produced in the Production Example for coating fluid production were successively applied by dip coating on the resultant cylinder in such amounts as to result in dry film thicknesses of 0.4 μm and 18 μm, respectively, and dried to form a charge generation layer and a charge transport layer. Thus, a photoreceptor drum was produced. The drying for forming the charge transport layer was conducted at 125° C. for 20 minutes. The charge transport layer of the photoreceptor obtained was peeled off and analyzed for any residual solvents by gas chromatography [apparatus: 7890, manufactured by Agilent Technologies, Inc.]. As a result, the amounts of residual solvents in the photosensitive layer were found to be such that the content of halogen-free solvents

[sum of tetrahydrofuran and toluene] was 9.5 mg/g and no halogenated solvent was detected.

Example 7

A photoreceptor was produced by conducting the same procedure as in Example 6, except that the component proportion in the tetrahydrofuran/toluene mixed solvent to be used in <Production of Coating Fluid for Charge Transport Layer Formation> in Example 6 was changed so that the mixed solvent was composed of 90% by weight tetrahydrofuran and 10% by weight toluene (coating fluid C9) and that the drying conditions for the charge transport layer were changed to 135° C. and 30 minutes. The charge transport layer of the photoreceptor obtained was peeled off and analyzed for any residual solvents in the same manner as in Example 6. As a result, the amounts of residual solvents in the photosensitive layer were found to be such that the content of halogen-free solvents [sum of tetrahydrofuran and toluene] was 2.2 mg/g and no halogenated solvent was detected.

Example 8

A photoreceptor was produced by conducting the same procedure as in Example 6, except that the polyarylate resin made up of repeating structural units of the formula (resin X) to be used in <Production of Coating Fluid for Charge Transport Layer Formation> in Example 6 was replaced with one having a viscosity-average molecular weight of 53,000 (coating fluid C10). The charge transport layer of the photoreceptor obtained was peeled off and analyzed for any residual solvents in the same manner as in Example 6. As a result, the content of halogen-free solvents [sum of tetrahydrofuran and toluene] was 10.1 mg/g and no halogenated solvent was detected.

Example 9

A photoreceptor was produced by conducting the same procedure as in Example 6, except that the drying conditions for the charge transport layer in Example 6 were changed to 120 degrees and 10 minutes. The charge transport layer of the photoreceptor obtained was peeled off and analyzed for any residual solvents in the same manner as in Example 6. As a result, the content of halogen-free solvents [sum of tetrahydrofuran and toluene] was 17.5 mg/g and no halogenated solvent was detected.

Example 10

A photoreceptor was produced by conducting the same procedure as in Example 6, except that the polyarylate resin made up of repeating structural units of the formula (resin X) to be used in <Production of Coating Fluid for Charge Transport Layer Formation> in Example 6 was replaced with one having a viscosity-average molecular weight of 20,400 (coating fluid C11). The charge transport layer of the photoreceptor obtained was peeled off and analyzed for any residual solvents in the same manner as in Example 6. As a result, the content of halogen-free solvents [sum of tetrahydrofuran and toluene] was 9.9 mg/g and no halogenated solvent was detected.

Example 11

A photoreceptor was produced by conducting the same procedure as in Example 6, except that the tetrahydrofuran/toluene mixed solvent to be used in <Production of Coating Fluid for Charge Transport Layer Formation> in Example 6 was replaced with 1,2-dicloroethane (coating fluid C12). The charge transport layer of the photoreceptor obtained was peeled off and analyzed for any residual solvents in the same manner as in Example 6. As a result, no halogen-free solvent was detected and the content of the halogenated solvent was 1.3 mg/g.

<Printing Durability Evaluation Test>

Each photoreceptor obtained was mounted in the drum cartridge of an A4 tandem type full-color printer [a machine obtained by modifying COREFIDO C711dn, manufactured by Oki Data Corp. (printing speed, color 34 rpm; resolution, 600 dpi; exposure light source, LED)], and this cartridge was set in the printer.

The printer was placed in a low-temperature low-humidity environment, and data on a pattern which was symmetrical with respect to upside-and-downside symmetry and right-and-left symmetry and which was configured of solid images and line images and had a coverage rate of 5% were sent, as an input for printing, from a personal computer to the printer to conduct 12,500-sheet printing in the one-sheet intermittent mode.

After the printing durability test, the thickness of the charge transport layer was measured. The printing durability was evaluated by comparing the charge transport layer thicknesses measured before and after the printing durability test.

⊙: The difference in charge transport layer thickness between before and after the durability test is less than 2.0 μm.

○: The difference in charge transport layer thickness between before and after the durability test is 2.0 μm or larger but less than 2.5 μm.

Δ: The difference in charge transport layer thickness between before and after the durability test is 2.5 μm or larger but less than 3.0 μm.

×: The difference in charge transport layer thickness between before and after the durability test is 3.0 μm or larger.

<Evaluation of the Electrophotographic Photoreceptors>

The electrophotographic photoreceptors obtained in Examples 6 to 11 were each mounted on an apparatus for electrophotographic-property evaluation produced in accordance with the measurement standards of The Society of Electrophotography of Japan (described in The Society of Electrophotography of Japan, ed., *Zoku Denshi Shashin Gijutsu No Kiso To Ōyō*, Corona Publishing Co., Ltd., pp. 404-405, 1996), and cycling which included charging, exposure, potential measurement, and erase was performed in the following manner to thereby evaluate the electrical properties.

Under the conditions of a temperature of 25° C. and a humidity of 50%, the photoreceptor was charged so as to result in an initial surface potential of −700 V and then exposed, at an irradiation energy of 0.6 $\mu J/cm^2$, to monochromatic light of 780 nm obtained from the light of a halogen lamp by means of an interference filter. Thereafter, the surface potential (unit: −V) was measured and taken as residual potential.

The results of the evaluation of printing durability and electrophotographic photoreceptor properties (residual potential) are shown in Table 2.

TABLE 2

| | CT | Coating fluid | Binder Molecular weight | Content of residual solvents (mg/g) Halogen-free | Halogenated | Residual potential (−V) | Printing durability |
|---|---|---|---|---|---|---|---|
| Example 6 | Production Example 3 | C8 | 72,000 | 9.5 | 0 | 27 | ⊙ |
| Example 7 | Production Example 3 | C9 | 72,000 | 2.2 | 0 | 27 | ⊙ |
| Example 8 | Production Example 3 | C10 | 53,000 | 10.1 | 0 | 29 | ○ |
| Example 9 | Production Example 3 | C8 | 72,000 | 17.5 | 0 | 34 | ○ |
| Example 10 | Production Example 3 | C11 | 20,400 | 9.9 | 0 | 28 | Δ |
| Example 11 | Production Example 3 | C12 | 72,000 | 0 | 1.3 | 38 | ○ |

While the invention has been described in detail and with reference to specific embodiments thereof, it will be apparent to one skilled in the art that various changes and modifications can be made therein without departing from the spirit and scope thereof. This application is based on a Japanese patent application filed on Jan. 21, 2014 (Application No. 2014-008594) and a Japanese patent application filed on Jan. 31, 2014 (Application No. 2014-017157), the entire contents thereof being incorporated herein by reference.

DESCRIPTION OF THE REFERENCE NUMERALS AND SIGNS

1 Photoreceptor (electrophotographic photoreceptor)
2 Charging device (charging roller; charging part)
3 Exposure device (exposure part)
4 Developing device (developing part)
5 Transfer device
6 Cleaning device
7 Fixing device
41 Developing vessel
42 Agitator
43 Feed roller
44 Developing roller
45 Control member
71 Upper fixing member (fixing roller)
72 Lower fixing member (fixing roller)
73 Heater
T Toner
P Recording paper (paper, medium)

The invention claimed is:

1. A charge transport substance, comprising:
a compound and
palladium,
wherein a palladium content is 0.01-150 ppm, and
the compound is of formula (1):

(1)

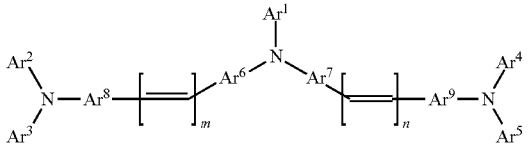

wherein $Ar^1$ to $Ar^5$ each independently represent an aryl group which optionally has an alkyl or alkoxy group,
$Ar^6$ to $Ar^9$ each independently represent a 1,4-phenylene group which optionally has a substituent, and
m and n each independently represent an integer of 1-2.

2. An electrophotographic photoreceptor, comprising:
a conductive support and,
a photosensitive layer disposed thereover, the photosensitive layer comprising a charge transport substance,
wherein the charge transport substance comprises a compound and palladium, the charge transport substance having a palladium content of 0.01-150 ppm, and
the compound is of formula (1):

(1)

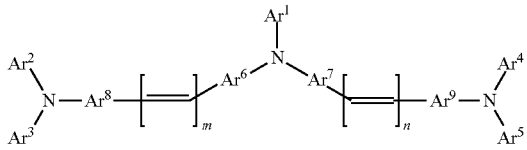

wherein $Ar^1$ to $Ar^5$ each independently represent an aryl group which optionally has a substituent.
$Ar^6$ to $Ar^9$ each independently represent a 1,4-phenylene group which optionally has a substituent, and
m and n each independently represent an integer of 1 to 3.

3. The electrophotographic photoreceptor according to claim 2, wherein the photosensitive layer comprises a binder resin, the binder resin having a viscosity-average molecular weight of 40,000-100,000.

4. The electrophotographic photoreceptor according to claim 2 wherein:
a content of a residual halogenated solvent in the photosensitive layer is 1.0 mg/g or less, and
a content of a residual halogen-free solvent in the photosensitive layer is 0.05-20.0 mg/g.

5. The electrophotographic photoreceptor according to claim 2, wherein the compound of formula (1) is present in the photosensitive layer in an amount of 20-50 parts by mass per 100 parts by mass of a binder resin in the photosensitive layer.

6. The electrophotographic photoreceptor according to claim 2, wherein in formula (1),
$Ar^1$ to $Ar^5$ each independently are an aryl group which optionally has an alkyl or alkoxy group, $Ar^6$ to $Ar^9$ each independently are a 1,4-phenylene group which optionally has a substituent, and m and n are 1.

7. The electrophotographic photoreceptor according to claim 2, wherein the compound of formula (1) has been purified with an adsorbent.

8. The electrophotographic photoreceptor according to claim 2, wherein the electrophotographic photoreceptor is suitable for use in a full-color image forming apparatus.

9. An electrophotographic cartridge, comprising:

the electrophotographic photoreceptor according to claim 2; and at least one selected from the group consisting of a charging device configured to charge the electrophotographic photoreceptor, an exposure device configured to expose the charged electrophotographic photoreceptor to light to form an electrostatic latent image, and a developing device configured to develop the electrostatic latent image formed in the surface of the electrophotographic photoreceptor.

10. A full-color image forming apparatus, comprising:

the electrophotographic photoreceptor according to claim 2;

a charging device configured to charge the electrophotographic photoreceptor;

an exposure device configured to expose charged electrophotographic photoreceptor to light to form electrostatic latent image; and a developing device configured to develop the electrostatic latent image formed in the surface of the electrophotographic photoreceptor.

11. An electrophotographic photoreceptor, comprising:

a conductive support and a photosensitive layer disposed thereover, wherein the photosensitive layer comprises a compound and palladium, the photosensitive layer having a palladium content of 0.01-50 ppm, and the compound is of formula (1):

(1)

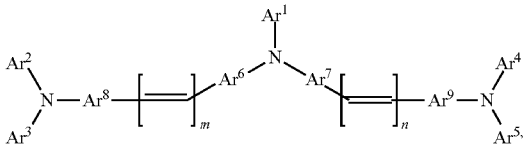

wherein $Ar^1$ to $Ar^5$ each independently represent an aryl group which optionally has a substituent, $Ar^6$ to $Ar^9$ each independently represent a 1,4-phenylene group which optionally has a substituent, and m and n each independently represent an integer of 1 to 3.

12. The electrophotographic photoreceptor according to claim 11, wherein the photosensitive layer comprises a binder resin, the binder resin having a viscosity-average molecular weight of 40,000-100,000.

13. The electrophotographic photoreceptor according to claim 11, wherein:

a content of a residual halogenated solvent in the photosensitive layer is 1.0 mg/g or less, and a content of a residual halogen-free solvent in the photosensitive layer is 0.05-20.0 mg/g.

14. The electrophotographic photoreceptor according to claim 11, wherein the compound of formula (1) is present in the photosensitive layer in an amount of 20-50 parts by mass per 100 parts by mass of a binder resin in the photosensitive layer.

15. The electrophotographic photoreceptor according to claim 11, wherein in formula (1), $Ar^1$ to $Ar^5$ each independently are an aryl group which optionally has an alkyl or alkoxy group, $Ar^6$ to $Ar^9$ each independently are a 1,4-phenylene group which optionally has a substituent, and m and n are 1.

16. The electrophotographic photoreceptor according to claim 11, wherein the photosensitive layer comprises a polyarylate resin or a polycarbonate resin as a binder resin.

17. The electrophotographic photoreceptor according to claim 11, wherein the compound of formula (1) has been purified with an adsorbent.

18. The electrophotographic photoreceptor according to claim 11, wherein the electrophotographic photoreceptor is suitable for use in a full-color image forming apparatus.

19. An electrophotographic cartridge, comprising:

the electrophotographic photoreceptor according to claim 11; and at least one selected from the group consisting of a charging device configured to charge the electrophotographic photoreceptor, an exposure device configured to expose the charged electrophotographic photoreceptor to light to form an electrostatic latent image, and a developing device configured to develop the electrostatic latent image formed in the surface of the electrophotographic photoreceptor.

20. A full-color image following apparatus, comprising:

the electrophotographic photoreceptor according to claim 11;

a charging device configured to charge the electrophotographic photoreceptor;

an exposure device configured to expose the charged electrophotographic photoreceptor to light to form an electrostatic latent image; and a developing device configured to develop the electrostatic latent image formed in the surface of the electrophotographic photoreceptor.

* * * * *